US009987728B2

(12) United States Patent
Garg et al.

(10) Patent No.: US 9,987,728 B2
(45) Date of Patent: Jun. 5, 2018

(54) ABRASIVE ARTICLES INCLUDING AN ABRASIVE PERFORMANCE ENHANCING COMPOSITION

(71) Applicants: SAINT-GOBAIN ABRASIVES, INC., Worcester, MA (US); SAINT-GOBAIN ABRASIFS, Conflans-Sainte-Honorine (FR)

(72) Inventors: Ajay K. Garg, Indore (IN); Frank J. Csillag, Hopkinton, MA (US); Manikandan Rajamohan, Chennai (IN)

(73) Assignees: Saint-Gobain Abrasives, Inc., Worcester, MA (US); Saint-Gobin Abrasifs, Conflans-Sainte-Honorine (FR)

( * ) Notice: Subject to any disclaimer, the term of this patent is extended or adjusted under 35 U.S.C. 154(b) by 0 days. days.

(21) Appl. No.: 15/400,943

(22) Filed: Jan. 6, 2017

(65) Prior Publication Data

US 2017/0197293 A1 Jul. 13, 2017

(30) Foreign Application Priority Data

Jan. 8, 2016 (IN) ..... 201641000880

(51) Int. Cl.
*B24D 3/24* (2006.01)
*B24D 7/02* (2006.01)
*B24D 3/34* (2006.01)

(52) U.S. Cl.
CPC ..... *B24D 3/34* (2013.01); *B24D 7/02* (2013.01)

(58) Field of Classification Search
CPC ..... B24D 3/34; B24D 7/02
See application file for complete search history.

(56) References Cited

U.S. PATENT DOCUMENTS

| | | | |
|---|---|---|---|
| 1,573,061 | A | 2/1926 | Hartmann |
| 2,258,774 | A | 10/1941 | Kuzmick |
| 3,058,819 | A | 10/1962 | Paulson |
| 3,502,453 | A | 3/1970 | Baratto |
| 3,795,496 | A | 3/1974 | Greenwood |
| 3,806,956 | A | 4/1974 | Supkis et al. |

(Continued)

FOREIGN PATENT DOCUMENTS

| | | |
|---|---|---|
| CN | 101758463 B | 5/2012 |
| CN | 101791786 B | 6/2012 |

OTHER PUBLICATIONS

International Search Report for the International Application PCT/US2017/012638 dated May 1, 2017, 1 page.

(Continued)

*Primary Examiner* — Pegah Parvini
(74) *Attorney, Agent, or Firm* — Abel Law Group, LLP; Joseph P. Sullivan

(57) ABSTRACT

The present invention relates generally to fixed abrasive articles comprising: abrasive particles; a binder composition; and an abrasive performance enhancing composition, wherein the abrasive particles are disposed on or in the binder composition, and wherein the abrasive performance enhancing composition is disposed overlying the abrasive particles or binder composition or both. The abrasive performance enhancing composition comprises a mixture comprising a lubricant and an anti-wear agent. In particular embodiments the abrasive performance enhancing composition further comprises a fixative material.

17 Claims, 14 Drawing Sheets

(56) References Cited

U.S. PATENT DOCUMENTS

| | | | |
|---|---|---|---|
| 3,833,346 | A | 9/1974 | Wirth |
| 3,997,302 | A | 12/1976 | Supkis |
| 4,095,961 | A | 6/1978 | Wirth |
| 5,221,295 | A | 6/1993 | Zador |
| 5,441,549 | A | 8/1995 | Helmin |
| 5,725,617 | A | 3/1998 | Hagiwara et al. |
| 5,961,674 | A | 10/1999 | Gagliardi et al. |
| 6,039,775 | A | 3/2000 | Ho et al. |
| 6,086,648 | A | 7/2000 | Rossetti, Jr. et al. |
| 6,270,543 | B1 | 8/2001 | Gagliardi et al. |
| 6,383,239 | B1 | 5/2002 | Suzuki et al. |
| 6,767,871 | B2 | 7/2004 | Devlin et al. |
| 8,568,499 | B2 | 10/2013 | Nagata |
| 2008/0153397 | A1 | 6/2008 | Laconto et al. |
| 2013/0014445 | A1 | 1/2013 | Wang et al. |
| 2014/0106126 | A1 | 4/2014 | Gaeta et al. |
| 2015/0080277 | A1 | 3/2015 | Koshima et al. |

OTHER PUBLICATIONS

Avila et al., 'Influence of Friction Modifier Additives on the Tribology of Lubricating Oils', Proceedings of COBEM, 2005, 8 pgs, Ouro Preto, (MG), Brazil.

ABRASIVE ARTICLES INCLUDING AN ABRASIVE PERFORMANCE ENHANCING COMPOSITION

CROSS-REFERENCE TO RELATED APPLICATION

The application claims priority under 35 U.S.C. § 119(a)-(d) to, and incorporates herein by reference in its entirety for all purposes, Indian Application 201641000880, filed Jan. 8, 2016, entitled "ABRASIVE ARTICLES INCLUDING AN ABRASIVE PERFORMANCE ENHANCING COMPOSITION", to Ajay K. GARG, Frank J. CSILLAG, and Manikandan RAJAMOHAN, which application is incorporated by reference herein in its entirety.

FIELD OF THE DISCLOSURE

The present invention relates generally to abrasive articles, such as fixed abrasive articles, that include an abrasive performance enhancing composition disposed on or within the abrasive article, as well as methods for producing such abrasive performance enhancing compositions and abrasive articles.

BACKGROUND

Abrasive articles, such as fixed abrasives, are used in various industries to abrade work pieces, such as by sanding, grinding, and polishing. Surface processing using abrasive articles spans a wide industrial scope from initial coarse material removal to high precision finishing and polishing of surfaces at a submicron level. Effective and efficient abrasion of workpiece surfaces, particularly metal and ceramic workpiece surfaces pose numerous processing challenges.

Therefore, there continues to be a demand for improved abrasive products and methods that can offer enhanced abrasive processing performance, efficiency, and improved surface quality.

BRIEF DESCRIPTION OF THE DRAWINGS

The present disclosure can be better understood, and its numerous features and advantages made apparent to those skilled in the art by referencing the accompanying drawings.

DETAILED DESCRIPTION

Figure 1:
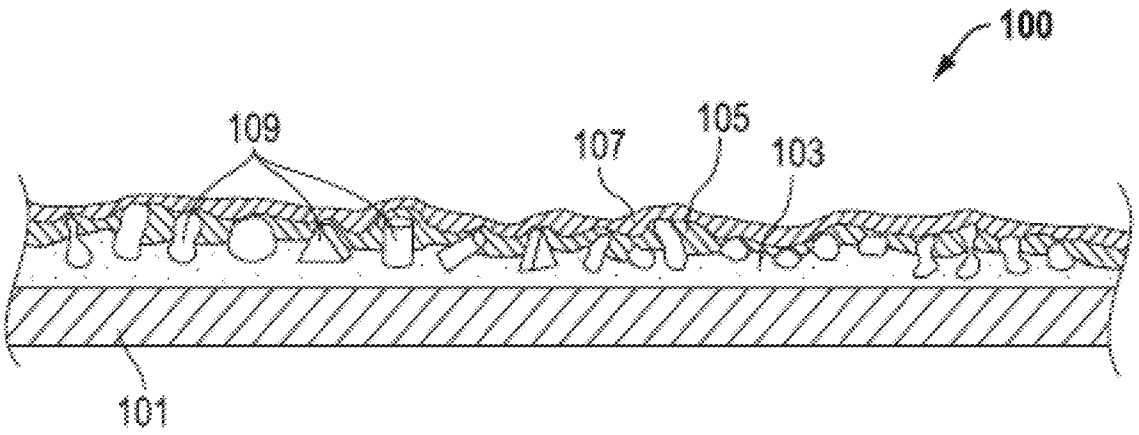
FIG. 1 is an illustration of a cross sectional view of a coated abrasive embodiment that includes an abrasive performance enhancing composition.

The following description, in combination with the figures, is provided to assist in understanding the teachings disclosed herein. The following discussion will focus on specific implementations and embodiments of the teachings. This discussion is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the fixed abrasive arts.

FIG. 1 shows an illustration of a cross section of a coated abrasive article 100 embodiment. An abrasive layer 111, which comprises abrasive particles 109 dispersed on or in a polymeric binder layer 103, is disposed on backing material 101. A size coat layer 105 is disposed on the abrasive layer. An abrasive performance enhancing composition 107 is disposed on the size coat layer. Optionally, a supersize coat layer (not shown) can be disposed between the size coat layer and the abrasive performance enhancing composition.

Figure 2B:
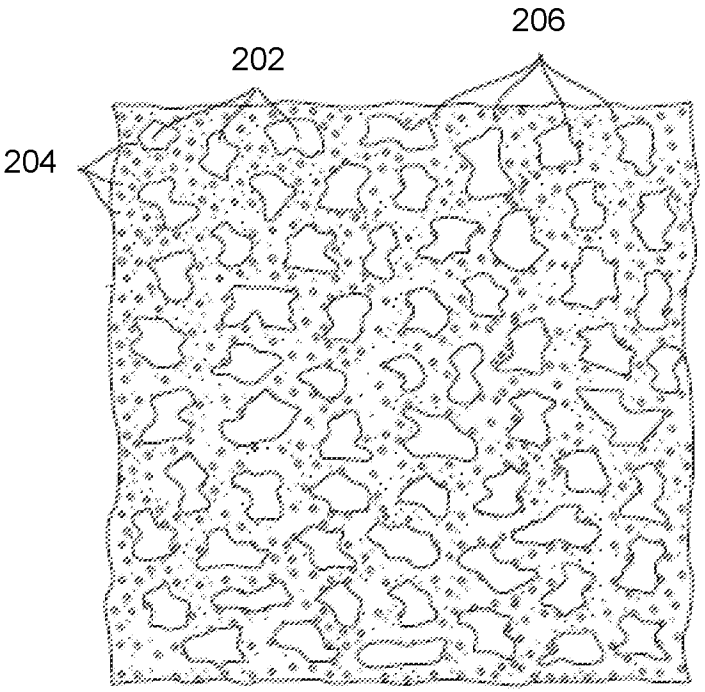
FIG. 2B is an illustration of a cross section of the bonded abrasive embodiment of FIG. 2A.
Figure 2A:
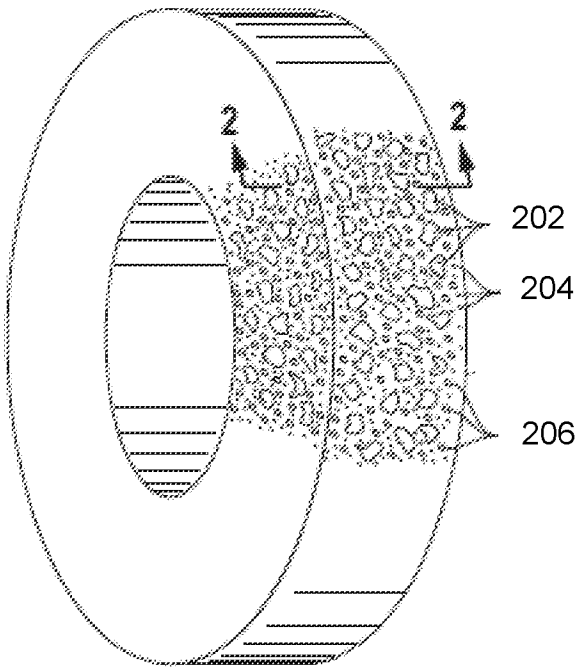
FIG. 2A is an illustration of a bonded abrasive embodiment that includes an abrasive performance enhancing composition.

FIG. 2 is an illustration of a bonded abrasive 200 embodiment. Abrasive particles 202 are dispersed within a porous bond material 204. The porous bond material comprises pores 206. An abrasive performance enhancing composition 208 is disposed in the pores of the porous bond material. Optionally, an outer coating (not shown) can be disposed over the surface of the bonded abrasive.

Figure 3:
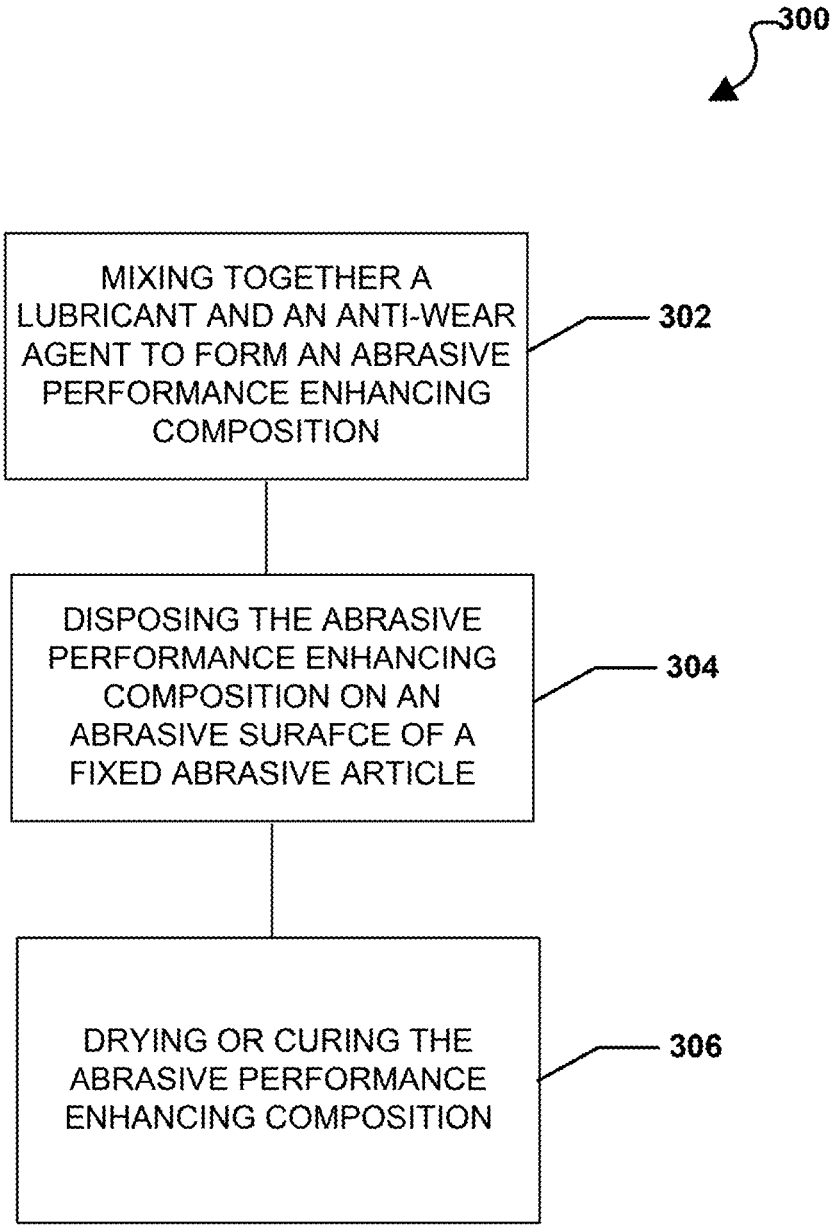
FIG. 3 is an illustration of a process flow diagram of a method making a fixed abrasive embodiment that includes an abrasive performance enhancing composition.

FIG. 3 is a flow diagram for a method 300 of making a fixed abrasive. In step 302, mixing together of a lubricant and an anti-wear agent to form an abrasive performance enhancing composition occurs. In step 304, disposing the abrasive performance enhancing composition on an abrasive surface of a fixed abrasive occurs. In step 306, drying and/or curing of the abrasive performance enhancing composition occurs.

Figure 4:
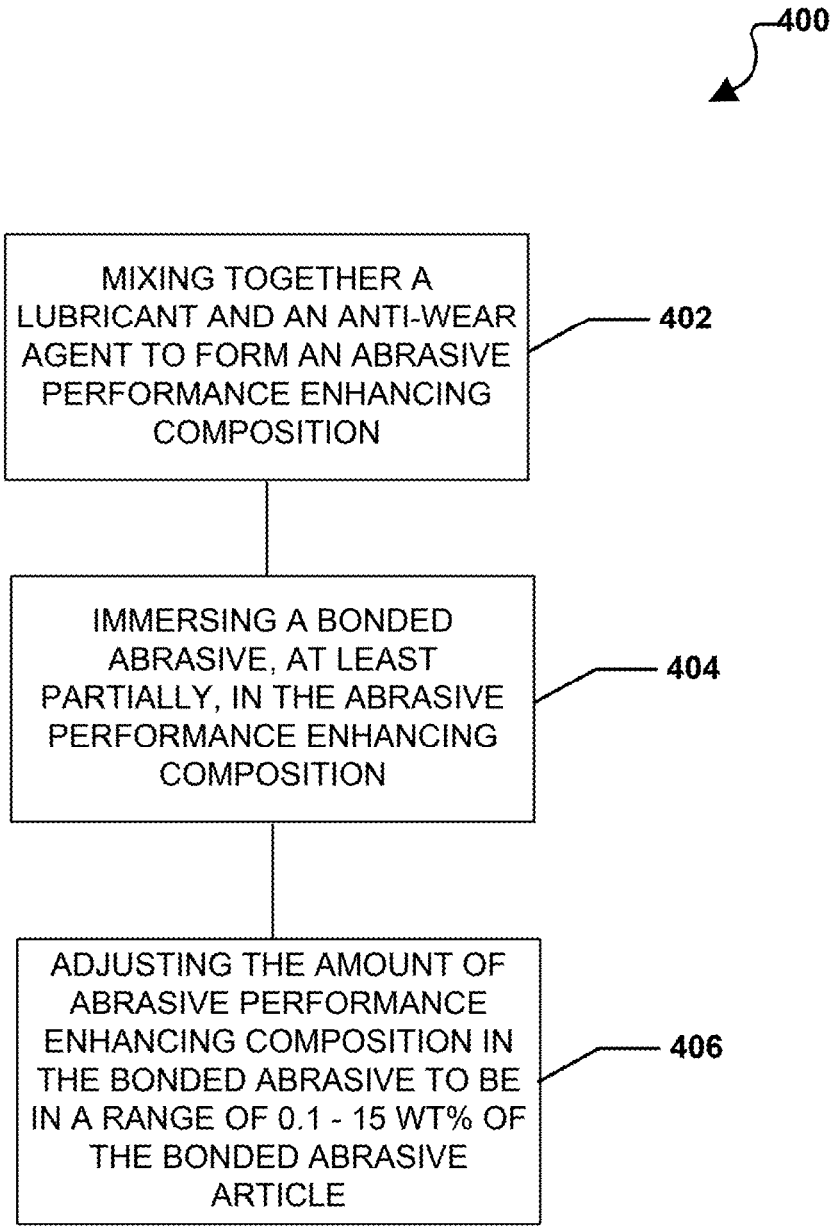
FIG. 4 is an illustration of a process flow diagram of a method of making a bonded abrasive embodiment that includes an abrasive performance enhancing composition.

FIG. 4 is a flow diagram for a method 400 of making a bonded abrasive. In step 402, mixing together of a lubricant and an anti-wear agent to form an abrasive performance enhancing composition occurs. In step 404, immersing a bonded abrasive, at least partially, in the abrasive performance enhancing composition occurs. In step 406, adjusting the amount of abrasive performance enhancing composition in the bonded abrasive to be in a range of 0.1-15 wt % of the bonded abrasive article occurs.

Figure 5:
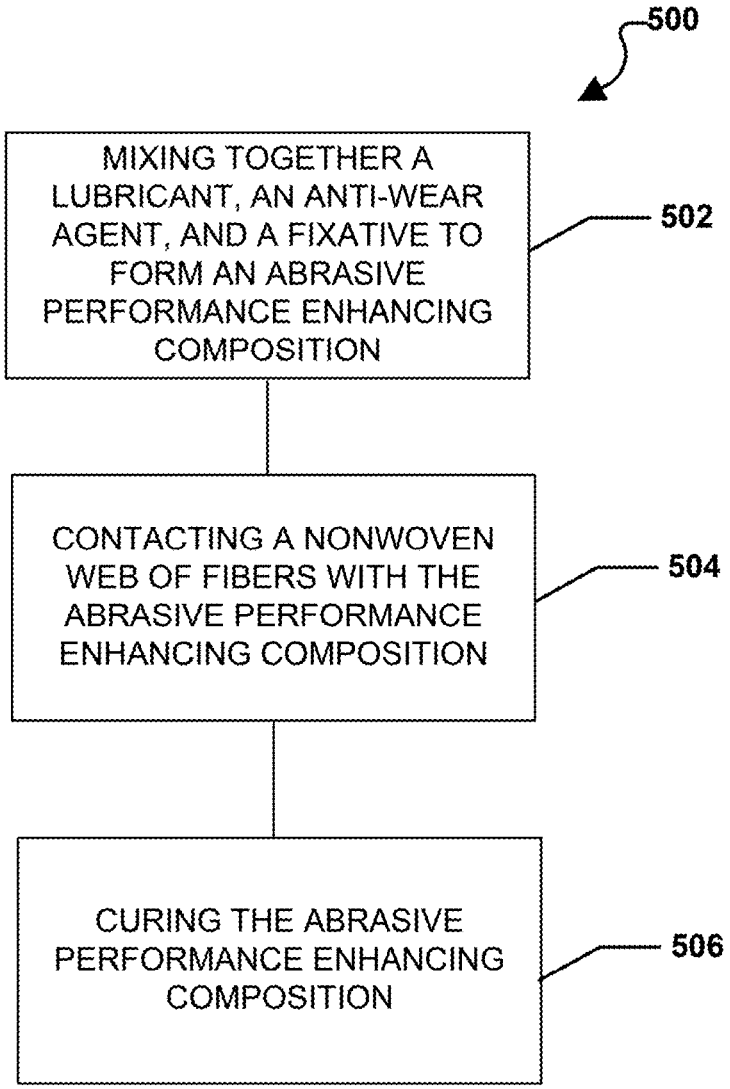
FIG. 5 is an illustration of a process flow diagram of a method of making a nonwoven abrasive embodiment that includes an abrasive performance enhancing composition.

FIG. 5 is an illustration of a process flow diagram of a method 500 of making a nonwoven abrasive embodiment that includes an abrasive performance enhancing composition. In step 502, the method includes mixing together a lubricant, an anti-wear agent, and a fixative to form an abrasive performance enhancing composition. In step 504, contacting a nonwoven web of fibers with the abrasive performance enhancing composition occurs. In step 506, the method includes curing the abrasive performance enhancing composition.

Figure 6:
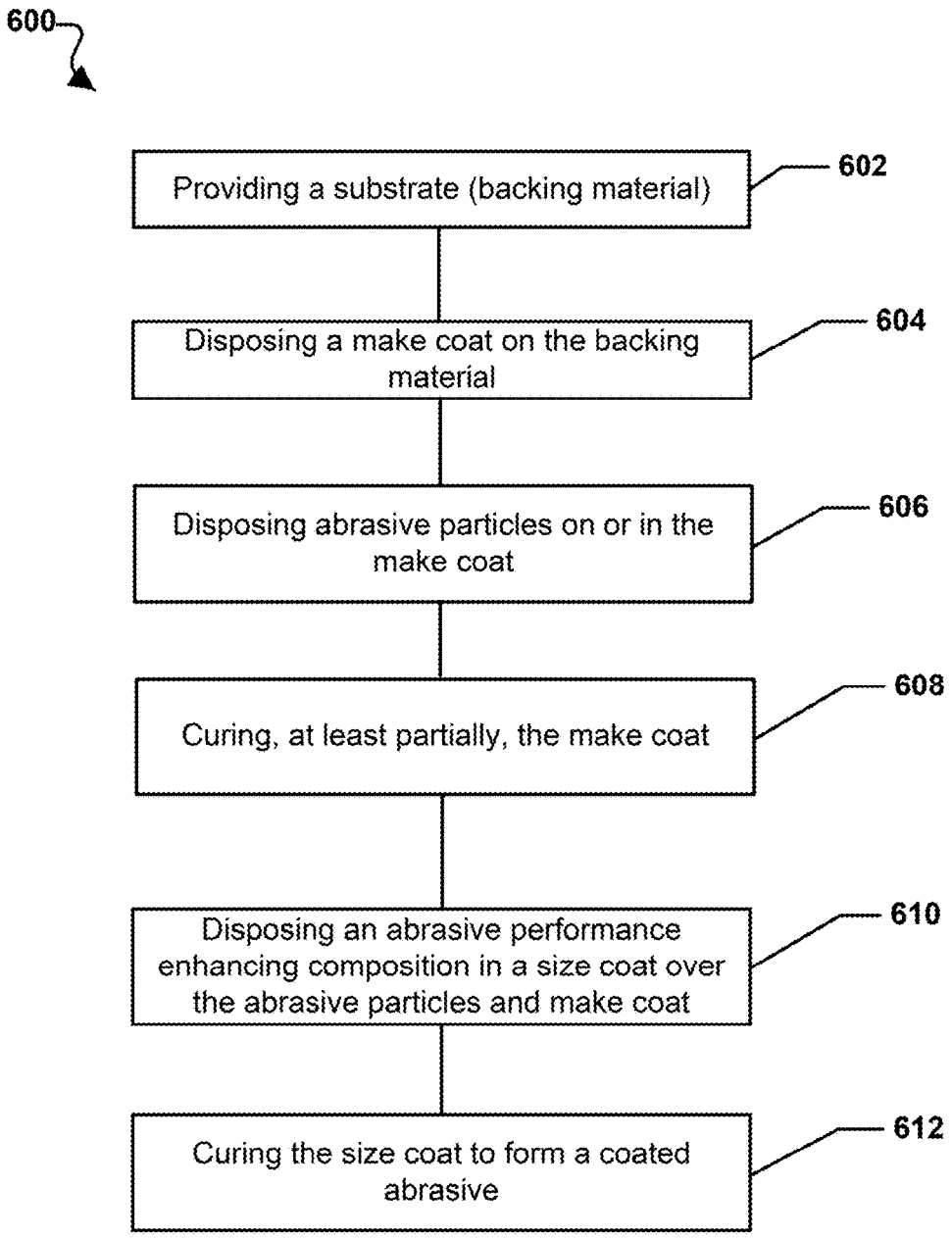
FIG. 6 is an illustration of a process flow diagram of a method of making a coated abrasive embodiment that includes an abrasive performance enhancing composition in a size coat.

FIG. 6 is an illustration of a process flow diagram of a method of making a coated abrasive embodiment that includes an abrasive performance enhancing composition in a size coat. In step 602, the method includes providing a substrate (backing material). In step 604, disposing a make coat on the backing material occurs. In step 606, the method includes disposing abrasive particles on or in the make coat. In step 608, curing, at least partially, the make coat occurs. In step 610, disposing an abrasive performance enhancing composition in a size coat over the abrasive particles and make coat occurs. In step 612, the method includes curing the size coat to form a coated abrasive.

Figure 7:
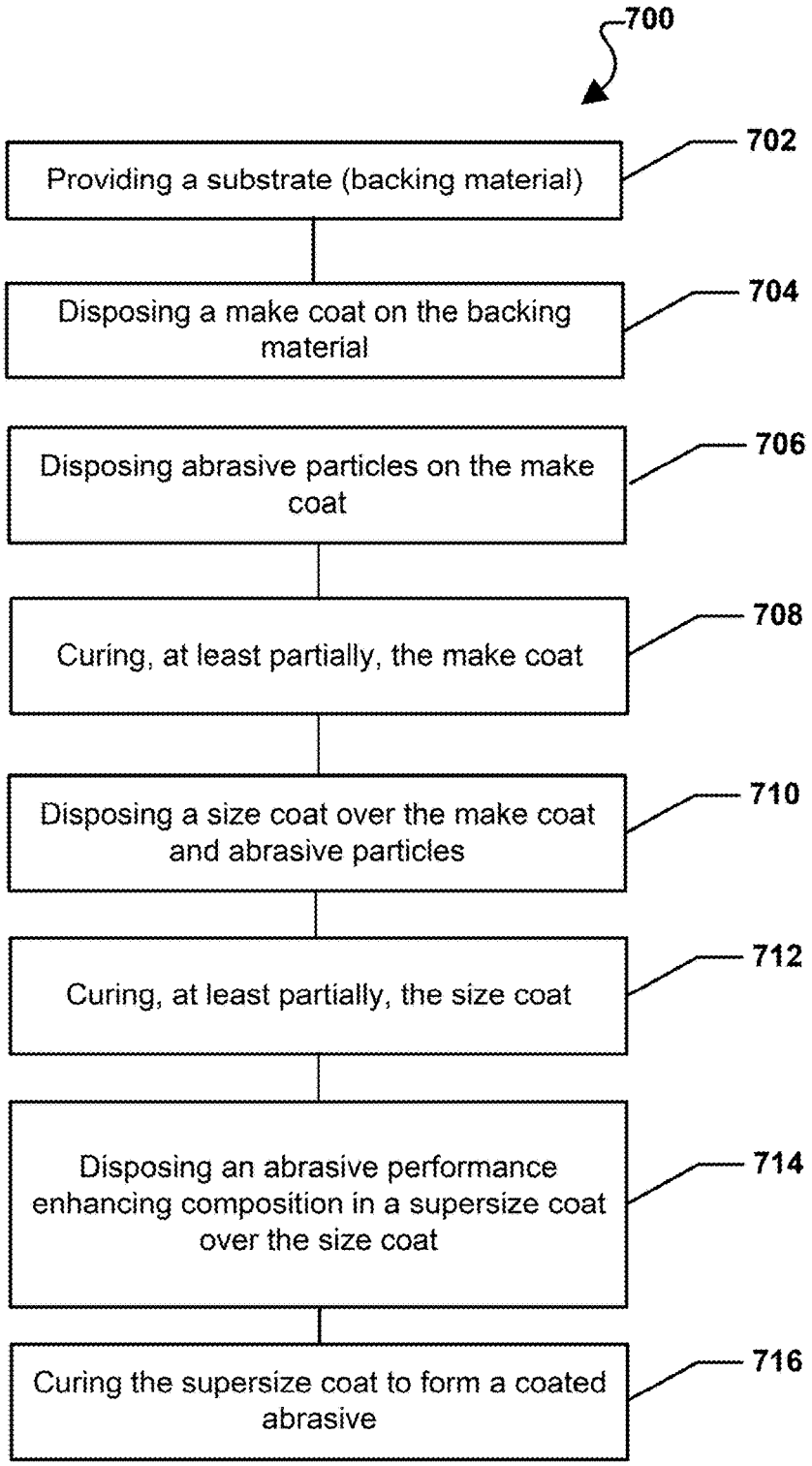
FIG. 7 is an illustration of a process flow diagram of a method of making a coated abrasive embodiment that includes an abrasive performance enhancing composition in a supersize coat.

FIG. 7 is an illustration of a process flow diagram of a method of making a coated abrasive embodiment that includes an abrasive performance enhancing composition in a supersize coat. In step 702, the method includes providing a substrate (backing material). In step 704, disposing a make coat on the backing material occurs. In step 706, the method includes disposing abrasive particles on or in the make coat. In step 708, the method includes curing, at least partially, the make coat. In step 710, disposing a size coat over the abrasive particles and make coat occurs. In step 712, the method includes curing, at least partially, the size coat. In step 714, disposing an abrasive performance enhancing composition in a supersize coat over the make coat occurs. In step 716, the method includes curing the supersize coat to form a coated abrasive.

Fixed Abrasive

In an embodiment the abrasive article is a fixed abrasive article. Fixed abrasive articles include coated abrasive articles, bonded abrasive articles, nonwoven abrasive articles, engineered abrasive articles, and combinations thereof. Fixed abrasive articles can be in the form of discs, belts, wheels, thin wheels, flap wheels, flap discs, polishing films, and the like.

Abrasive Performance Enhancing Composition

In an embodiment, the fixed abrasive article includes an abrasive performance enhancing composition. The abrasive performance enhancing composition comprises a mixture comprising a lubricant, and an anti-wear agent. The abrasive performance enhancing composition can be an admixture comprising a lubricant and an anti-wear agent.

Lubricant

In an embodiment, the lubricant can comprise a hydrocarbon material or mixtures of hydrocarbon materials, such as alkanes, cycloalkanes, or combinations thereof. In an embodiment, the hydrocarbon material can have at least 5 carbon atoms, such as at least 8 carbon atoms, such as at least 10 carbon atoms, such as at least 12 carbon atoms. In another embodiment, the hydrocarbon material can have not greater than 100 carbon atoms, such as not greater than 90 carbon atoms, not grant greater than 80 carbon atoms, not greater than 70 carbon atoms, not greater than 60 carbon atoms, or not greater than 50 carbon atoms. In a particular embodiment, the hydrocarbon material can have at least 5 carbon atoms to 100 carbon atoms, such as from at least 8 carbon atoms to 70 carbon atoms, such as at least 10 carbon atoms to 60 carbon atoms, such as from 12 carbon atoms to 50 carbon atoms.

In an embodiment, the lubricant can comprise a paraffin material, such as a liquid paraffin, a solid paraffin, or combinations thereof. In a particular embodiment, the paraffin material can comprise what is commonly known as liquid paraffin (also called, "white oil", "mineral oil"), a paraffin wax, or combinations thereof.

In an embodiment, the lubricant can comprise an oil, a wax, a grease, or combinations thereof. In a particular embodiment, the oil can be a mineral oil, a vegetable oil, an animal oil, a synthetic oil, or combinations thereof. In a particular embodiment, the oil can comprise a mineral oil, such as any of various light mixtures of higher alkanes from a mineral source, particularly a distillate of petroleum. In a particular embodiment, the oil can be what is commonly known as "motor oil" or "engine oil". Suitable motor oils and engine oils can be those oils rated for viscosity by the Society for Automotive Engineers ("SAE") designated as SAE 5W, 10W, 15W, 20W, 25W, 20, 30, 40, 50, or 60 weight oil, or combinations thereof. In a particular embodiment, the lubricant is an SAE 20w-40 motor oil.

In an embodiment, a vegetable oil is an oil that is extracted from a plant, usually from the fruits or seeds. Suitable vegetable oils can include canola oil, coconut oil, corn oil, cottonseed oil, olive oil, palm oil, peanut oil, rapeseed oil, safflower oil, sesame oil, soybean oil, sunflower oil, and combination thereof.

The amount of lubricant in the abrasive performance enhancing composition can vary. In an embodiment, the amount of lubricant can be not less than 1 weight percent of the composition, such as not less than 3 weight percent, not less than 5 weight percent, not less than 10 weight percent, not less than 20 weight percent, not less than 30 weight percent, not less than 40 weight percent, not less than 50 weight percent, not less than 60 weight percent, not less than 70 weight percent, or not less than 80 weight percent of the abrasive performance enhancing composition. In an embodiment, the amount of lubricant in the abrasive performance enhancing composition can be not greater than 99 weight percent of the composition, such as not greater than 95 weight percent, not greater than 90 weight percent, not greater than 80 weight percent, not greater than 70 weight percent, not greater than 60 weight percent, not greater than 55 weight percent, not greater than 50 weight percent, not greater than 40 weight percent, not greater than 30 weight percent, or not greater than 20% of the abrasive performance enhancing composition. The amount of lubricant can be within a range comprising a pair of any of the previous upper and lower limits. In a particular embodiment, the amount of lubricant in the abrasive performance enhancing composition can be within a range of 1 weight percent to 99 weight percent of the abrasive performance enhancement composition, such as from 5 weight percent to 95 weight percent, such as from 10 weight percent to 90 weight percent, such as from 20 weight percent to 80 weight percent, such as from 40 weight percent to 70 weight percent of the abrasive performance enhancement composition.

Anti-Wear Agent

In an embodiment, the anti-wear agent can comprise an organophosphate, such as a phosphate ester, a thiophosphate ester, a dithiophosphate ester, or combinations thereof. In an embodiment, the anti-wear agent can include a transition metal. In an embodiment, the anti-wear agent can include zinc. Suitable anti-wear agents that include zinc are zinc dithiophosphates (ZDP), zinc dialkyl dithio phosphates (ZDDP), or a combination thereof. The ZDDP can be monomeric ZDDP, dimeric ZDDP, tetrameric ZDDP (also called basic ZDDP), polymeric ZDDP, or combinations thereof. In an embodiment, the anti-wear agent can include molybdenum. In an embodiment, the anti-wear agent can comprise a molybdenum dithiophosphate, such as a molybdenum dialkyl dithiophosphate. In a specific embodiment, the anti wear agent can comprise a zinc dioctyl primary alkyl dithiophosphate, a zinc butyl octyl primary alkyl dithiophosphate, a zinc primary-secondary dialkyl dithiophosphate, a molybdenum dialkyl dithiophosphate, a zinc C1-C14 alkyldithiophosphate, or a combination thereof. In another embodiment, the anti-wear agent does not include zinc or molybdenum. Suitable anti-wear agents that do not include zinc or molybdenum can be "ashless" dithiophosphates, such as dialkyldithiophphoric acid, amino dialkydithiophosphate salts, aminodialklydithiophates, fluorothiophosphates (FTP), alkylphosphorofluoridothiolates, alkylthioperoxydithiophosphates and combinations thereof. In another embodiment, an antiwear agent can be a tricresyl phosphate (TCP).

The amount of anti-wear agent in the abrasive performance enhancing composition can vary. In an embodiment, the amount of anti-wear agent can be not less than 0.01 weight percent of the composition, such as not less than 0.05 weight percent, not less than 0.1 weight percent, not less than 0.15 weight percent, not less than 0.2 weight percent, not less than 0.3 weight percent, not less than 0.4 weight percent, not less than 0.5 weight percent, not less than 0.75 weight percent, not less than 1.0 weight percent, not less than 1.5 weight percent, not less than 2.0 weight percent, not less than 3.0 weight percent, not less than 5.0 weight percent, not less than 6.0 weight percent, not less than 7.5 weight percent, not less than 10 weight percent, not less than 15 weight percent, not less than 20 weight percent, not less than 25 weight percent, or not less than 30 weight percent of the abrasive performance enhancing composition. In an embodiment, the amount of anti-wear agent in the abrasive performance enhancing composition can be not greater than 96 weight percent of the composition, such as not greater than 94 weight percent, not greater than 92 weight percent, not greater than 90 weight percent, not greater than 88 weight percent, not greater than 86 weight percent, not greater than 84 weight percent, not greater than 82 weight percent, not greater than 80 weight percent, 79 weight percent, not greater than 77 weight percent, not greater than 75 weight percent, not greater than 70 weight percent, not greater than 65 weight percent, not greater than 60 weight percent, not greater than 55 weight percent, not greater than 50 weight percent, not greater than 45 weight percent, not greater than 40 weight percent, not greater than 35 weight percent, or not greater than 30%. The amount of anti-wear agent can be within a range comprising a pair of any of the previous upper and lower limits. In a particular embodiment, the amount of anti-wear agent in the abrasive performance enhancing composition can be within a range of 0.01 weight percent to 80 weight percent of the abrasive performance enhancement composition, such as from 0.05 weight percent to 79 weight percent, such as from 1.0 weight percent to 77 weight percent, such as from 1.5 weight percent to 75 weight percent of the abrasive performance enhancement composition.

Fixative Material

In an embodiment, the abrasive performance enhancing composition can further comprise a fixative material. The fixative material can comprise a binder or glue material capable of fixing or adhering the abrasive performance enhancing composition to an abrasive article, such as by drying, curing, adsorption, or other suitable adhesion method. In an embodiment, the fixative can be an organic binder, an inorganic binder, or a combination thereof. In an embodiment, the fixative can be a glue, such as a natural glue, synthetic glue, or a combination thereof. In a particular embodiment, a glue comprises polyvinyl acetate (e.g., Fevicol). In another embodiment, the fixative can be a polymeric resin or combination of polymeric resins. In a particular embodiment, the fixative comprises a phenolic resin. In another embodiment, the fixative can comprise a clay, such as a natural clay, modified natural clay, including functionalized clays (e.g., Cloisite clay), synthetic clays, or combinations thereof. In another embodiment, the fixative can comprise a hydrous mineral, such as a calcium aluminum sulfate mineral (e.g., Ettringite—Ca6Al2(SO4)3(OH) 12.26H2O).

The amount of fixative material in the abrasive performance enhancing composition can vary. In an embodiment, the amount of fixative material can be not less than 1.0 weight percent of the composition, such as not less than 5 weight percent, not less than 10 weight percent, not less than 15 weight percent, not less than 20 weight percent, not less than 30 weight percent, not less than 40 weight percent, not less than 50 weight percent, not less than 55 weight percent, not less than 60 weight percent, or not less than 65 weight percent of the abrasive performance enhancing composition. In an embodiment, the amount of fixative material in the abrasive performance enhancing composition can be not greater than 90 weight percent of the composition, such as not greater than 85 weight percent, not greater than 80 weight percent, not greater than 75 weight percent, not greater than 70 weight percent, not greater than 65 weight percent, not greater than 60 weight percent, not greater than 55 weight percent, not greater than 50 weight percent, not greater than 45 weight percent, not greater than 40 weight percent, not greater than 35 weight percent, or not greater than 30% of the abrasive performance enhancing composition. The amount of fixative material can be within a range comprising a pair of any of the previous upper and lower limits. In a particular embodiment, the amount of fixative material in the abrasive performance enhancing composition can be within a range of 1.0 weight percent to 95 weight percent of the abrasive performance enhancement composition, such as from 10 weight percent to 90 weight percent of the abrasive performance enhancement composition.

Abrasive Performance Enhancement Composition Additives

In an embodiment the abrasive performance enhancement composition can further comprise additives that affect the physical properties or the tribological properties of the composition and/or the abrasive performance of the fixed abrasive. Abrasive performance enhancement composition additives can comprise friction modifiers, extreme pressure additives, antioxidant additives, ant-foam agents, corrosion inhibitors, detergents, dispersants, viscosity index modifiers, pour point modifiers, multi-function agents, and combinations thereof. In a particular embodiment, the abrasive performance enhancement composition additives are those that are particularly suitable for affecting the physical and tribological properties of motor oil.

In an embodiment, friction modifiers can include long-chain fatty acids, their derivatives, molybdenum compounds, and combinations thereof.

In an embodiment, extreme pressure additives can include organosulfur compounds, organophosphorus compounds, such as organic polysulfides, phosphates, dithiophosphates, dithiocarbamates, and combinations thereof. In particular embodiments extreme pressure additives can comprise dialkyl hydrogen phosphites, trialkyl phosphites, monoalkyl phosphoric acids, dialkyl phosphoric acids, dialkyl dithiophosphoric acids, trialkyl phosphates, trialkyl thiophosphates, trialkyl dithiophosphates, dialkyl phosphates, dialkyl thiophosphonates, trialkyl tetrathiolphosphonates, and combinations thereof.

In an embodiment, anti-oxidant additives include sulfur compounds, phosphorus compounds, sulfur phosphorus compounds, aromatic amine compounds, hindered phenolic compounds, organo alkaline earth salt compounds, organo zinc compounds, organo copper compounds, organo molybdenum compounds, and combinations thereof.

In an embodiment, corrosion inhibitors can include amine succinates, alkaline earth sulfonates, and combinations thereof.

In an embodiment, detergents can include "soaps", i.e., metal salts of organic acids. In contrast, dispersants are metal free and are typically of higher molecular weights than detergents. In an embodiment, detergents can include neutral or basic detergents, such as sodium detergents, potassium detergents, magnesium detergents, calcium detergents, barium detergents, and combinations thereof. In an embodiment, dispersants can include ester dispersants, imide dispersants, amide dispersants, olefin dispersants, and combinations thereof.

In an embodiment, viscosity index modifiers can include poly methacrylates, poly isobutenes, olefin copolymers, styrene/diene copolymers, and combinations thereof.

In an embodiment, pour point additives can include waxes, such as chlorinated paraffin waxes; alkyl aromatic polymers, polymethacrylates, polyacrylates, paraffin phenols, and combinations thereof.

The amount of additives (whether as a single additive or combination of additives) in the abrasive performance enhancing composition can vary. In an embodiment, the amount of additives can be not less than 0.01 weight percent of the composition, such as not such as not less than 0.05 weight percent, not less than 0.1 weight percent, not less than 0.15 weight percent, not less than 0.2 weight percent, not less than 0.3 weight percent, not less than 0.4 weight percent, not less than 0.5 weight percent, not less than 0.75 weight percent, not less than 1.0 weight percent, not less than 1.5 weight percent, not less than 2.0 weight percent, not less than 3.0 weight percent, not less than 5.0 weight percent, not less than 6.0 weight percent, not less than 7.5 weight percent, not less than 10 weight percent, or not less than 15 weight percent of the abrasive performance enhancing composition. In an embodiment, the amount of additives in the abrasive performance enhancing composition can be not greater than 35 weight percent of the composition, such as not greater than 30 weight percent, not greater than 25 weight percent, not greater than 20 weight percent, or not greater than 15 weight percent of the abrasive performance enhancing composition. The amount of additives can be within a range comprising a pair of any of the previous upper and lower limits. In a particular embodiment, the amount of additives in the abrasive performance enhancing composition can be within a range of 0.01 weight percent to 35 weight percent of the abrasive performance enhancement composition, such as from 0.05 weight percent to 30 weight percent of the abrasive performance enhancement composition.

Specific Beneficial Chemical Moieties

In an embodiment, the abrasive performance enhancing composition can comprise one or more specific beneficial chemical moieties. In an embodiment, the specific beneficial chemical moieties can be present in a particular combination and/or a particular amount. In an embodiment, the specific beneficial chemical moieties can be present in a particular minimum amount, a particular maximum amount, a particular range, or combinations thereof. In an embodiment, the specific beneficial chemical moieties can include zinc, phosphorus, sulfur, calcium, or combinations thereof. In a particular embodiment, the specific beneficial chemical moiety is zinc. In another particular embodiment, the specific beneficial chemical moieties can include zinc and at least one of phosphorus, sulfur, or calcium. In another particular embodiment, the specific beneficial chemical moiety is phosphorus. In another particular embodiment, the specific beneficial chemical moieties can include phosphorus and at least one of zinc, sulfur, or calcium. In another particular embodiment, the specific beneficial chemical moiety is sulfur. In another particular embodiment, the specific beneficial chemical moieties can include sulfur and at least one of zinc, phosphorus, or calcium. In another particular embodiment, the specific beneficial chemical moiety is calcium. In another particular embodiment, the specific beneficial chemical moieties can include calcium and at least one of zinc, phosphorus, or sulfur.

Zinc Content

As stated above, the specific beneficial chemical moieties can be present in a particular combination and/or a particular amount. In an embodiment, the amount of zinc is at least 100 ppm, such as at least 300 ppm, such as at least 500 ppm, such as at least 700 ppm, such as at least 900 ppm, or such as at least 1000 ppm. In an embodiment, the amount of zinc can be not greater than 500,000 ppm, such as not greater than 400,000 ppm, not greater than 300,000 ppm, not greater than 200,000 ppm, not greater than 190,000 ppm, not greater than 180,000 ppm, not greater than 170,000, not greater than 160,000 ppm, or not greater than 150,000 ppm. The amount of zinc can be within a range comprising any pair of the previous upper and lower limits. In a particular embodiment, the amount of zinc ranges from at least 100 ppm to not greater than 500,000 ppm, such as at least 1000 ppm to not greater than 200,000 ppm, such as at least 10,000 ppm to not greater than 180,000 ppm. In another particular embodiment, the amount of zinc ranges from 1000 ppm to not greater than 180,000 ppm, such as at least 1,000 ppm to not greater than 25,000 ppm. In another particular embodiment, the amount of zinc is at least 10,000 ppm to not greater than 180,000 ppm, such as at least 15,000 ppm to not greater than 180,000 ppm, such as at least 10,000 ppm to not greater than 50,000 ppm. In another particular embodiment, the amount of zinc is at least 50,000 ppm to not greater than 300,000 ppm, such as at least 100,000 ppm to not greater than 200,000 ppm, such as at least 120,000 ppm to not greater than 180,000 ppm.

Phosphorus Content

As stated above, the specific beneficial chemical moieties can be present in a particular combination and/or a particular amount. In an embodiment, the amount of phosphorus is at least 100 ppm, such as at least 300 ppm, such as at least 500 ppm, such as at least 700 ppm, such as at least 900 ppm, or such as at least 1000 ppm. In an embodiment, the amount of phosphorus can be not greater than 500,000 ppm, such as not greater than 400,000 ppm, not greater than 300,000 ppm, not greater than 200,000 ppm, not greater than 190,000 ppm, not greater than 180,000 ppm, not greater than 170,000, not greater than 160,000 ppm, or not greater than 150,000 ppm. The amount of phosphorus can be within a range comprising any pair of the previous upper and lower limits. In a particular embodiment, the amount of phosphorus ranges from at least 100 ppm to not greater than 500,000 ppm, such as at least 1000 ppm to not greater than 200,000 ppm, such as at least 10,000 ppm to not greater than 180,000 ppm. In another particular embodiment, the amount of phosphorus ranges from 1000 ppm to not greater than 180,000 ppm, such as at least 1,000 ppm to not greater than 30,000 ppm. In another particular embodiment, the amount of phosphorus is at least 10,000 ppm to not greater than 180,000 ppm, such as at least 15,000 ppm to not greater than 180,000 ppm, such as at least 10,000 ppm to not greater than 50,000 ppm. In another particular embodiment, the amount of phosphorus is at least 50,000 ppm to not greater than 300,000 ppm, such as at least 100,000 ppm to not greater than 200,000 ppm, such as at least 100,000 ppm to not greater than 180,000 ppm.

Sulfur Content

As stated above, the specific beneficial chemical moieties can be present in a particular combination and/or a particular amount. In an embodiment, the amount of sulfur is at least 100 ppm, such as at least 300 ppm, such as at least 500 ppm, such as at least 700 ppm, such as at least 900 ppm, or such as at least 1000 ppm. In an embodiment, the amount of sulfur can be not greater than 600,000 ppm, such as not greater than 500,000 ppm, not greater than 450,000 ppm, not greater than 400,000 ppm, not greater than 375,000 ppm, not greater than 350,000 ppm, not greater than 325,000 ppm, or not greater than 300,000 ppm. The amount of sulfur can be within a range comprising any pair of the previous upper and lower limits. In a particular embodiment, the amount of sulfur ranges from at least 100 ppm to not greater than 600,000 ppm, such as at least 1000 ppm to not greater than 500,000 ppm, such as at least 2,000 ppm to not greater than 450,000 ppm. In another particular embodiment, the amount of sulfur ranges from 1000 ppm to not greater than 500,000 ppm, such as at least 2,000 ppm to not greater than 400,000 ppm, or at least 2,000 ppm to not greater than 350,000 ppm. In another particular embodiment, the amount of sulfur is at least 2,000 ppm to not greater than 400,000 ppm, such as at least 2,000 ppm to not greater than 15,000 ppm, or such as at least 10,000 ppm to not greater than 50,000 ppm, or such as 100,000 ppm to not greater than 350,000 ppm. In another particular embodiment, the amount of sulfur is at least 50,000 ppm to not greater than 400,000 ppm, such as at least 100,000 ppm to not greater than 350,000 ppm.

Calcium Content

As stated above, the specific beneficial chemical moieties can be present in a particular combination and/or a particular amount. In an embodiment, the amount of calcium is at least 100 ppm, such as at least 300 ppm, such as at least 500 ppm, such as at least 700 ppm, such as at least 900 ppm, or such as at least 1000 ppm. In an embodiment, the amount of calcium can be not greater than 100,000 ppm, such as not greater than 90,000 ppm, not greater than 80,000 ppm, not greater than 70,000 ppm, not greater than 60,000 ppm, not greater than 50,000 ppm, not greater than 40,000, not greater than 30,000 ppm, or not greater than 20,000 ppm. The amount of calcium can be within a range comprising any pair of the previous upper and lower limits. In a particular embodiment, the amount of calcium ranges from at least 100 ppm to not greater than 100,000 ppm, such as at least 1000 ppm to not greater than 50,000 ppm, such as at least 2,000 ppm to not greater than 20,000 ppm. In another particular embodiment, the amount of calcium ranges from 1000 ppm to not greater than 20,000 ppm, such as at least 2,000 ppm to not greater than 10,000 ppm.

Grinding Aids

In an embodiment, the abrasive performance enhancing composition can comprise grinding aids. In an embodiment, grinding aids can be inorganic based; such as halide salts, for example cryolite, wollastonite, and potassium fluoroborate; or organic based, such as sodium lauryl sulphate, or chlorinated waxes, such as a chlorinated paraffin (e.g. 1 to 89 wt % chlorine) or a chlorinated plastic, such as polyvinyl chloride. In an embodiment, the grinding aid can be an environmentally sustainable material.

The amount of grinding aids in the abrasive performance enhancing composition can vary. In an embodiment, the amount of grinding aids can be not less than 1.0 weight percent of the composition, such as not such as not less than 1.5 weight percent, not less than 2.0 weight percent, not less than 5.0 weight percent, not less than 7.0 weight percent, not less than 10 weight percent, not less than 15 weight percent, not less than 20 weight percent, not less than 25 weight percent, not less than 30 weight percent, not less than 35 weight percent, not less than 40 weight percent, or not less than 45 weight percent of the abrasive performance enhancing composition. In an embodiment, the amount of grinding aids in the abrasive performance enhancing composition can be not greater than 80 weight percent of the composition, such as not greater than 75 weight percent, not greater than 70 weight percent, not greater than 65 weight percent, not greater than 60 weight percent, not greater than 55 weight percent, or not greater than 50 weight percent of the abrasive performance enhancing composition. The amount of grinding aids can be within a range comprising a pair of any of the previous upper and lower limits. In a particular embodiment, the amount of grinding aids in the abrasive performance enhancing composition can be within a range of 1.0 weight percent to 80 weight percent of the abrasive performance enhancement composition, such as from 1.55 weight percent to 75 weight percent of the abrasive performance enhancement composition.

Composition Ratios

The amounts of component materials of the abrasive performance enhancing composition can be in particular ratios to each other that are beneficial. In an embodiment the ratio of lubricant to fixative ranges from 3:1 to 1:20, such as 1:1 to 1:3.

Encapsulation

In an embodiment, the abrasive performance enhancing composition can be encapsulated. Encapsulation can be accomplished by any encapsulation methods or procedures known in the art.

Dispersion into Other Layers of a Fixed Abrasive

The abrasive performance enhancing composition can be disposed into other traditional layers or component features of a fixed abrasive. In an embodiment, the abrasive performance enhancing composition can be dispersed into one or more of the coating layers of a coated abrasive (make coat, size coat, supersize coat, or combination thereof). In another embodiment, the abrasive performance enhancing composition can be dispersed into the binder matrix of a bonded abrasive (in open pores, in closed pores, encapsulated and dispersed into the binder matrix), or applied as an external layer to the surface of the bonded abrasive, or a combination thereof. In another embodiment, an abrasive performance enhancing composition can be disposed in a nonwoven abrasive article, such as on or in the nonwoven web of a nonwoven abrasive article. In a specific embodiment, an abrasive performance enhancing composition can be disposed in a make coat of a coated abrasive. In a specific embodiment, an abrasive performance enhancing composition can be disposed in a size coat of a coated abrasive. In a specific embodiment, an abrasive performance enhancing composition can be disposed in a supersize coat of a coated abrasive. In a specific embodiment, an abrasive performance enhancing composition can be disposed in both a size coat and in a supersize coat of a coated abrasive. In an embodiment, the amount of abrasive performance enhancing composition can comprise from 0.1 to 70 wt % of a fixed abrasive article, such as 1 to 60 wt % of a fixed abrasive article, such as 2 to 40 wt % of a fixed abrasive article, such as 3 to 30 wt % of a fixed abrasive article. In another embodiment, the amount of abrasive performance enhancing composition can comprise from 0.1 to 60 wt %, such as 1 to 50 wt %, such a 2 to 40 wt %, such as 2 to 30 wt % of a make coat, of a size coat, of a supersize coat or a combination thereof of a coated abrasive article.

Preparing the Abrasive Performance Enhancing Composition

An abrasive performance enhancing composition can be prepared by mixing together, as desired, the lubricant and the anti-wear agent, abrasive performance enhancing additives, if any, a fixative, if any, and a grinding aid, if any. Mixing can be accomplished by methods generally known in the art.

Applying the Abrasive Performance Enhancing Composition

The abrasive performance enhancing composition can be applied to the fixed abrasive in various beneficial ways. In an embodiment, the abrasive performance enhancing composition is applied externally to the abrasive surface of the fixed abrasive. In specific embodiments, the abrasive performance enhancing composition can be applied by use of a brush or spatula, particularly when the composition is highly viscous at room temperature. In another embodiment, particularly when the fixed abrasive is porous, the fixed abrasive can be soaked or saturated in the abrasive performance enhancing composition for a sufficient amount of time for the abrasive performance enhancing composition to adequately disperse within the body or abrasive layer of the fixed abrasive. The fixed abrasive can then be dried or drained of excess abrasive performance enhancing composition. In a particular embodiment, the fixed abrasive is drained by hanging followed by spinning at a desired speed and for a sufficient duration to set the amount of abrasive performance enhancing composition at a desired amount.

Coated Abrasive

Backing

The backing material (also referred to herein as "a backing") can be flexible or rigid. The backing can be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yarns comprising polyester, nylon, silk, cotton, poly-cotton, rayon, or combinations thereof); paper; vulcanized paper; vulcanized rubber; vulcanized fiber; nonwoven materials; a combination thereof; or a treated version thereof. Cloth backings can be woven or stitch bonded. In particular examples, the backing is selected from the group consisting of paper, polymer film, cloth (e.g., cotton, poly-cotton, rayon, polyester, poly-nylon), vulcanized rubber, vulcanized fiber, metal foil and a combination thereof. In other examples, the backing includes polypropylene film or polyethylene terephthalate (PET) film.

The backing can optionally have at least one of a saturant, a presize layer (also called a "front fill layer"), or a backsize layer (also called a "back fill layer"). The purpose of these layers is typically to seal the backing or to protect yarn or fibers in the backing. If the backing is a cloth material, at least one of these layers is typically used. The addition of the presize layer or backsize layer can additionally result in a "smoother" surface on either the front or the back side of the backing. Other optional layers known in the art can also be used such as a tie layer.

The backing can be a fibrous reinforced thermoplastic or an endless spliceless belt. Likewise, the backing can be a polymeric substrate having hooking stems projecting therefrom or be a loop fabric.

Abrasive Layer

The abrasive layer comprises a plurality of abrasive particles disposed on, or dispersed in, a polymeric binder composition. In an embodiment, an abrasive layer includes abrasive particles disposed on, or dispersed in, a binder composition.

Abrasive Grains/Particles

Abrasive particles can include essentially single phase inorganic materials, such as alumina, silicon carbide, silica, ceria, and harder, high performance superabrasive particles such as cubic boron nitride and diamond. Additionally, the abrasive particles can include composite particulate materials. Such materials can include aggregates, which can be formed through slurry processing pathways that include removal of the liquid carrier through volatilization or evaporation, leaving behind unfired ("green") aggregates, that can optionally undergo high temperature treatment (i.e., firing, sintering) to form usable, fired aggregates. Further, the abrasive regions can include engineered abrasives including macrostructures and particular three-dimensional structures.

In an embodiment, the abrasive particles are blended with the binder formulation to form abrasive slurry. Alternatively, the abrasive particles are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive particles can be formed of any one of or a combination of abrasive particles, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive particles can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive particles comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

Particle Size

In an embodiment, the abrasive particles can have an average particle size not greater than 4000 microns, such as not greater than 2000 microns, such as not greater than about 1500 microns, not greater than about 1000 microns, not greater than about 750 microns, or not greater than 500 microns. In another embodiment, the abrasive particle size is at least 0.1 microns, at least 1 micron, at least 5 microns, at least 10 microns, at least 25 microns, or at least 45 microns. In another embodiment, the abrasive particles size is from about 0.1 microns to about 2000 microns. The particle size of the abrasive particles is typically specified to be the longest dimension of the abrasive particle. Generally, there is a range distribution of particle sizes. In some instances, the particle size distribution is tightly controlled.

Binder Composition—Make Coat or Abrasive Slurry

The binder composition (commonly known as the make coat) can be formed of a single polymer or a blend of polymers. The binder composition can be formed from an epoxy composition, acrylic composition, a phenolic composition, a polyurethane composition, a phenolic composition, a polysiloxane composition, or combinations thereof. In addition, the binder composition can include active filler particles, as described above, additives, or a combination thereof.

The binder composition generally includes a polymer matrix, which binds abrasive particles to the backing or to a compliant coat, if such a compliant coat is present. Typically, the binder composition is formed of cured binder formulation. In an embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The coated abrasive article can comprise a size coat disposed on the abrasive layer. The size coat can be the same as or different from the polymer binder composition used to form the size coat of the abrasive layer. The size coat can comprise any conventional compositions known in the art that can be used as a size coat. The size coat can include one or more additives.

Super Size Coat

The coated abrasive article can comprise a supersize coat disposed on the size coat. The supersize coat can be the same as or different from the polymer binder composition of the binder composition of the make coat. The supersize coat composition includes active filler particles, as described above. The supersize coat can include one or more additives in addition to the active filler particles.

Additives

The make coat, size coat, or supersize coat can include one or more additives. Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives can be present in any part of the overall system of the coated abrasive product according to embodiments of the present disclosure. Suitable grinding aids can be inorganic based; such as halide salts, for example cryolite, wollastonite, and potassium fluoroborate; or organic based, such as sodium lauryl sulphate, or chlorinated waxes, such as polyvinyl chloride. In an embodiment, the grinding aid can be an environmentally sustainable material.

Bonded Abrasive

In an embodiment, the fixed abrasive comprises a bonded abrasive, such as a bonded abrasive wheel. A bonded abrasive comprises abrasive particles dispersed in a binder material (also called herein a bond matrix) that has been formed into a suitable shape for grinding or polishing a workpiece.

The bonded abrasive binder material can comprise a mineral material, organic material, or a combination thereof. The bonded abrasive binder material can comprise a vitreous composition, a ceramic composition, a polymeric composition, or a combination thereof. In a particular embodiment, the bonded abrasive binder material comprises as vitreous composition. In another embodiment, the bonded abrasive binder material comprises a polymeric composition. Suitable polymeric compositions can be any of the polymeric compositions listed above with respect to a coated abrasive binder. In a particular embodiment, the bonded abrasive binder material comprises a phenolic composition.

The bonded abrasive can include pores (i.e., be porous). The pores can be open pores, closed pores, or a combination thereof. The pores can be interconnected, closed, or a combination thereof.

The amount of pores in the bonded abrasive (i.e. the amount of porosity) can vary. In an embodiment, the amount of porosity can be zero. In another embodiment, the amount of porosity can be not less than 0.01 volume percent of the bonded abrasive, such as not such as not less than 0.05 volume percent, not less than 1.0 volume percent, not less than 1.5 volume percent, not less than 2.0 volume percent, or not less than 5.0 volume percent of the bonded abrasive. In an embodiment, the amount of porosity in the bonded abrasive can be not greater than 50 volume percent of the bonded abrasive, such as not greater than 40 volume percent, not greater than 30 volume percent, not greater than 20 volume percent, not greater than 15 volume percent, or not greater than 10 volume percent of the bonded abrasive. The amount of porosity can be within a range comprising a pair of any of the previous upper and lower limits. In a particular embodiment, the amount of porosity in the bonded abrasive can be within a range of 0.01 volume percent to 50 volume percent of the bonded abrasive, such as from 0.05 volume percent to 25 volume percent of the bonded abrasive.

Methods of Making

A fixed abrasive can be made that includes a performance enhancing composition as described herein. In an embodiment, an abrasive performance enhancing composition can be made by mixing together a lubricant and an anti-wear agent to form an abrasive performance enhancing composition occurs. The abrasive performance enhancing composition can be disposed on an abrasive surface of a fixed abrasive. The abrasive performance enhancing composition can be dried and/or cured to form the fixed abrasive including the performance enhancing composition.

In another embodiment, a lubricant and an anti-wear agent can be mixed together to form an abrasive performance enhancing composition. A bonded abrasive can be, at least partially, immersed in the abrasive performance enhancing composition. Alternatively, the bonded abrasive can be sprayed, coated, dipped, contacted, or a combination thereof to allow the bonded abrasive to absorb the abrasive performance enhancing composition. The amount of abrasive performance enhancing composition absorbed can vary. In an embodiment, the bonded abrasive is saturated with abrasive performance enhancing composition. In another embodiment, the bonded abrasive absorbs an amount of abrasive performance enhancing composition less than saturation. The amount absorbed can be from 0.1 to 50 wt % of the bonded abrasive article. The amount of abrasive performance enhancing composition in the bonded abrasive can be adjusted to be in a desired range. In an embodiment, the amount of abrasive performance enhancing composition in the bonded abrasive can be adjusted to be in a range of 0.1-15 wt % of the bonded abrasive article. Adjusting the amount of abrasive performance enhancing composition can be accomplished by draining, spinning, centrifuging, vacuuming, or drying the bonded abrasive, or a combination thereof.

In an embodiment, a nonwoven abrasive article including an abrasive performance enhancing composition can be made. A lubricant, an anti-wear agent, and a fixative can be mixed together to form an abrasive performance enhancing composition. A nonwoven web of fibers, such as a nonwoven web of lofty fibers, that includes abrasive grains adhered to the fibers can be contacted with the abrasive performance enhancing composition. The nonwoven web can be dipped, sprayed, coated, or a combination thereof. The amount of abrasive performance enhancing composition disposed on and/or in the nonwoven web can vary. In an embodiment, the nonwoven web can be saturated with the abrasive performance enhancing composition. In another embodiment, the nonwoven web can absorb an amount of abrasive performance enhancing composition less than saturation. The abrasive performance enhancing composition can be cured to form the nonwoven abrasive article. In an embodiment, the amount of abrasive performance enhancing composition can comprise from 0.5 to 70 wt % of the nonwoven abrasive, such as 1 to 60 wt % of the nonwoven abrasive article, such as 2 to 40 wt % of the nonwoven abrasive article.

In an embodiment, a coated abrasive article can be made that includes an abrasive performance enhancing composition in a make coat, size coat, a supersize coat, or a combination thereof. In an embodiment, a substrate (backing material) is provided. A make coat can be disposed on the backing material. In an embodiment, the abrasive performance enhancing composition is added to the make coat prior to disposing on the backing material. Abrasive particles can be disposed on or in the make coat. The make coat can be cured, at least partially. Partial to full curing prior to application of any further processing prevents the abrasive particles from laying down on the make coat. In an embodiment, the abrasive performance enhancing composition can be disposed in a size coat. In an embodiment, a size coat can be disposed over the abrasive particles and the make coat. The size coat can be cured to form a coated abrasive. In an alternative embodiment, the abrasive performance enhancing composition can be disposed in a supersize coat. The supersize coat can be disposed over the size coat. The supersize coat can be cured to form a coated abrasive.

LISTING OF EMBODIMENTS

Embodiment 1

An abrasive performance enhancing composition comprising:

a mixture comprising a lubricant, and an anti-wear agent.

Embodiment 2

The abrasive performance enhancing composition of embodiment 1, wherein the mixture further comprises a fixative.

Embodiment 3

The abrasive performance enhancing composition of embodiment 2, wherein the mixture is dried or cured.

Embodiment 4 the abrasive performance enhancing composition of embodiment 1, wherein the lubricant comprises a hydrocarbon material.

Embodiment 5

The abrasive performance enhancing composition of embodiment 4, wherein the hydrocarbon material comprises alkanes, cycloalkanes, or combinations thereof.

Embodiment 6

The abrasive performance enhancing composition of embodiment 4, wherein the hydrocarbon material has at least 5 carbon atoms.

Embodiment 7

The abrasive performance enhancing composition of embodiment 4, wherein the hydrocarbon material has not greater than 100 carbon atoms.

Embodiment 8

The abrasive performance enhancing composition of embodiment 1, wherein the lubricant comprises a paraffinic material, an oil, a wax, a grease, or a combination thereof.

Embodiment 9

The abrasive performance enhancing composition of embodiment 8, wherein the paraffinic material comprises a liquid paraffin, a solid paraffin, or combinations thereof.

Embodiment 10

The abrasive performance enhancing composition of embodiment 8, wherein the oil comprises a vegetable oil, a mineral oil, an animal oil, a synthetic oil, or combinations thereof.

Embodiment 11

The abrasive performance enhancing composition of embodiment 8, wherein the oil comprises a distillate of petroleum.

Embodiment 12

The abrasive performance enhancing composition of embodiment 8, wherein the oil comprises a motor oil.

Embodiment 13

The abrasive performance enhancing composition of embodiment 11, wherein the oil has a viscosity comparable to the viscosity rating by the Society for Automotive Engineers ("SAE") designated as SAE 5W, 10W, 15W, 20W, 25W, 20, 30, 40, 50, or 60 weight oil, or a combination thereof.

Embodiment 14

The abrasive performance enhancing composition of embodiment 10, wherein the vegetable oil comprises canola oil, coconut oil, corn oil, cottonseed oil, olive oil, palm oil, peanut oil, rapeseed oil, safflower oil, sesame oil, soybean oil, sunflower oil, their hydrogenated versions, or a combination thereof.

Embodiment 15

The abrasive performance enhancing composition of embodiment 2, wherein the fixative comprises an organic binder, an inorganic binder, or a combination thereof.

Embodiment 16

The abrasive performance enhancing composition of embodiment 2, wherein the fixative comprises a natural glue, a synthetic glue, or a combination thereof.

Embodiment 17 the abrasive performance enhancing composition of embodiment 16, wherein the glue comprises a polyvinyl acetate based resin.

Embodiment 18

The abrasive performance enhancing composition of embodiment 2, wherein the fixative comprises a polymeric resin.

Embodiment 19

The abrasive performance enhancing composition of embodiment 18, wherein the polymeric resin comprises a phenolic based resin.

Embodiment 20

The abrasive performance enhancing composition of embodiment 2, wherein the fixative comprises a natural clay, a modified natural clay, a functionalized clay, a synthetic clay, or a combination thereof.

Embodiment 21

The abrasive performance enhancing composition of embodiment 2, wherein the fixative comprises a hydrous mineral.

Embodiment 22

The abrasive performance enhancing composition of embodiment 21, wherein the hydrous mineral comprises calcium aluminum sulfate (Ettringite).

Embodiment 23

The abrasive performance enhancing composition of embodiment 1, wherein the anti-wear agent comprises an organo phosphate.

Embodiment 24

The abrasive performance enhancing composition of embodiment 23, wherein the organo phosphate is a phosphate ester, a thiophosphate ester, a dithiophosphate ester, or a combination thereof.

Embodiment 25

The abrasive performance enhancing composition of embodiment 23, wherein the organophosphate includes zinc.

Embodiment 26

The abrasive performance enhancing composition of embodiment 25, wherein the organophosphate comprises a zinc dithiophosphate (ZDP), a zinc dialkyl dithio phosphate (ZDDP), a tricresyl phosphate (TCP), or a combination thereof.

Embodiment 27

The abrasive performance enhancing composition of embodiment 23, wherein the organophosphate comprises an "ashless" dithiophosphate.

Embodiment 28

The abrasive performance enhancing composition of embodiment 27, wherein the "ashless" dithiophosphate comprises a dialkyldithiophphoric acid, an amino dialkydithiophosphate salt, an aminodialklydithiophate, or a combination thereof.

Embodiment 29

The abrasive performance enhancing composition of embodiment 1, further comprising an abrasive performance enhancing additive.

Embodiment 30

The abrasive performance enhancing composition of embodiment 29, wherein the abrasive performance enhancing additive comprises a friction modifier.

Embodiment 31

The abrasive performance enhancing composition of embodiment 30, wherein the friction modifier comprises a long-chain fatty acid, a long-chain fatty acid derivative, a molybdenum compound, or a combination thereof.

Embodiment 32

The abrasive performance enhancing composition of embodiment 29, wherein the abrasive performance enhancing additive comprises an extreme pressure additive.

Embodiment 33

The abrasive performance enhancing composition of embodiment 32, wherein the extreme pressure additive comprises an organosulfur compound, an organophosphorus compound, an organo-chloro compound, a calcium compound, or a combination thereof.

Embodiment 34

The abrasive performance enhancing composition of embodiment 33, wherein the organosulfur compound comprises an organic polysulfide, a phosphate, a dithiophosphate, a dithiocarbamate, or a combination thereof.

Embodiment 35

The abrasive performance enhancing composition of embodiment 33, wherein the organophosphorus compound comprises an organic polysulfide, a phosphate, a dithiophosphate, a dithiocarbamate, or a combination thereof.

Embodiment 36

The abrasive performance enhancing composition of embodiment 29, wherein the abrasive performance enhancing additive comprises an antioxidant additive.

Embodiment 37

The abrasive performance enhancing composition of embodiment 36, wherein the antioxidant additive comprises a sulfur compound, a phosphorus compound, a sulfur phosphorus compound, an aromatic amine compound, a hindered phenolic compound, an organo alkaline earth salt compound, an organo zinc compound, an organo copper compound, an organo molybdenum compound, or a combination thereof.

Embodiment 38

The abrasive performance enhancing composition of embodiment 29, wherein the abrasive performance enhancing additive comprises an anti-foam agent.

Embodiment 39

The abrasive performance enhancing composition of embodiment 29, wherein the abrasive performance enhancing additive comprises a corrosion inhibitor.

Embodiment 40

The abrasive performance enhancing composition of embodiment 39, wherein the corrosion inhibitor comprises an amine succinate, an alkaline earth sulfonate, or a combination thereof.

Embodiment 41

The abrasive performance enhancing composition of embodiment 29, wherein the abrasive performance enhancing additive comprises a detergent.

Embodiment 42

The abrasive performance enhancing composition of embodiment 41, wherein the detergent comprises a sodium detergent, a potassium detergent, a magnesium detergent, a calcium detergent, a barium detergent, or a combination thereof.

Embodiment 43

The abrasive performance enhancing composition of embodiment 29, wherein the abrasive performance enhancing additive comprises a dispersant.

Embodiment 44

The abrasive performance enhancing composition of embodiment 43, wherein the dispersant comprises an ester dispersant, an imide dispersant, an amide dispersant, an olefin dispersant, or a combination thereof.

Embodiment 45

The abrasive performance enhancing composition of embodiment 29, wherein the abrasive performance enhancing additive comprises a viscosity index modifier.

Embodiment 46

The abrasive performance enhancing composition of embodiment 45, wherein the viscosity index modifier comprises a poly methacrylate, a poly isobutene, an olefin copolymer, a styrene/diene copolymer, or a combination thereof.

Embodiment 47

The abrasive performance enhancing composition of embodiment 29, wherein the abrasive performance enhancing additive comprises a pour point modifier.

Embodiment 48

The abrasive performance enhancing composition of embodiment 47, wherein the pour point modifier comprises a wax, an alkyl aromatic polymer, a polymethacrylate, a polyacrylate, a paraffin phenol, or a combination thereof.

Embodiment 49

The abrasive performance enhancing composition of embodiment 29, wherein the abrasive performance enhancing additive comprises a multi-function agent.

Embodiment 50

The abrasive performance enhancing composition of embodiment 29 further comprising a grinding aid.

Embodiment 51

The abrasive performance enhancing composition of embodiment 50, wherein the grinding aid comprises a halide salt.

Embodiment 52

The abrasive performance enhancing composition of embodiment 50, wherein the grinding aid comprises sodium cryolite, potassium tetrafluoroborate; sodium lauryl sulphate; a chlorinated wax, a stearate, or a combination thereof.

Embodiment 53

The abrasive performance enhancing composition of embodiment 1 comprising at least 1 wt % of the lubricant.

Embodiment 54

The abrasive performance enhancing composition of embodiment 53 comprising not greater than 99.99 wt % of the lubricant.

Embodiment 55

The abrasive performance enhancing composition of embodiment 1 comprising at least 0.01 wt % of the anti-wear agent.

Embodiment 56

The abrasive performance enhancing composition of embodiment 55 comprising not greater than 80 wt % of the anti-wear agent.

Embodiment 57

The abrasive performance enhancing composition of embodiment 2 comprising at least 10 wt % of the fixative.

Embodiment 58

The abrasive performance enhancing composition of embodiment 57 comprising not greater than 90 wt % of the fixative.

Embodiment 59

The abrasive performance enhancing composition of embodiment 29 comprising at least 0.01 wt % of the abrasive performance enhancing additive.

Embodiment 60

The abrasive performance enhancing composition of embodiment 59 comprising not greater than 35 wt % of the abrasive performance enhancing additive.

Embodiment 61

The abrasive performance enhancing composition of embodiment 50 comprising at least 1 wt % of the grinding aid.

Embodiment 62

The abrasive performance enhancing composition of embodiment 61 comprising not greater than 80 wt % of the grinding aid.

Embodiment 63

The abrasive performance enhancing composition of embodiment 2 comprising:
5-98 wt % of the lubricant,
0.5-60 wt % of the anti-wear agent, and
2-80 wt % of the fixative Embodiment 64

The abrasive performance enhancing composition of embodiment 2, wherein the ratio of lubricant to fixative ranges from 5:1 to 1:20.

Embodiment 65

A fixed abrasive article comprising:
abrasive particles;
a binder composition; and
an abrasive performance enhancing composition according to embodiment 1,
wherein the abrasive particles are disposed on or in the binder composition, and
wherein the abrasive performance enhancing composition is disposed overlying the abrasive particles or binder composition or both, and
wherein the abrasive performance enhancing composition comprises a mixture comprising a lubricant, and
an anti-wear agent.

Embodiment 66

The fixed abrasive of embodiment 65, wherein the abrasive performance enhancing composition is encapsulated, microencapsulated, or a combination thereof.

Embodiment 67

The fixed abrasive of embodiment 65, wherein the abrasive performance enhancing composition further comprises a fixative material.

Embodiment 68

A coated abrasive article comprising:
an abrasive layer disposed on a backing; and
a abrasive performance enhancing composition disposed on the abrasive layer,
wherein the abrasive performance enhancing composition comprises
a dried mixture comprising
a lubricant,
an antiwear agent, and.
a fixative.

Embodiment 69

The coated abrasive article of embodiment 68, further comprising a size coat or supersize coat disposed between the abrasive layer and the abrasive performance enhancing composition.

Embodiment 70

The coated abrasive article of embodiment 69, wherein abrasive performance enhancing composition is dispersed in the make coat, abrasive layer, the size coat, the supersize coat, or combinations thereof.

Embodiment 71

The coated abrasive of embodiment 68, wherein the abrasive performance enhancing composition comprises 0.001 wt %-50 wt % of the coated abrasive article.

Embodiment 72

A bonded abrasive article comprising:
abrasive particles dispersed in a bond material and
a abrasive performance enhancing composition dispersed within the pores of the said bonded abrasive article,
wherein the abrasive performance enhancing composition comprises
a mixture comprising
a lubricant, and
an anti-wear agent.

Embodiment 73

The bonded abrasive of embodiment 72, wherein the abrasive performance enhancing composition comprises 0.001 wt %-25 wt % of the bonded abrasive article.

Embodiment 74

The bonded abrasive of embodiment 72, wherein the bond material comprises a metallic material, a ceramic material, a polymeric material, a vitreous material, or a combination thereof.

Embodiment 75

The bonded abrasive of embodiment 74, wherein the polymeric material comprises a phenolic resin.

Embodiment 76

The bonded abrasive of embodiment 72, wherein the porous bond material comprises an open porosity, a closed porosity, or a combination thereof.

Embodiment 77

The bonded abrasive of embodiment 76, wherein the open porosity, the closed porosity, or the combination thereof ranges from 0.1 vol % to 50 vol %.

Embodiment 78

The abrasive performance enhancing composition of embodiment 72, wherein the abrasive performance enhancing composition is dried or cured.

Embodiment 79

A method of making a fixed abrasive article comprising: disposing an abrasive performance enhancing composition on an abrasive surface of a fixed abrasive article.

Embodiment 80

The method of embodiment 79, further comprising:
mixing together a lubricant and an anti-wear agent to form abrasive performance enhancing composition prior to disposing the abrasive performance enhancing composition.

Embodiment 81

The method of embodiment 79, further comprising drying or curing the abrasive performance enhancing composition after disposing the abrasive performance enhancing composition.

Embodiment 82

A method of making a bonded abrasive article comprising:
saturating a bonded abrasive article with an abrasive performance enhancing composition.

Embodiment 83

The method of embodiment 82, further comprising:
mixing together a lubricant and an anti-wear agent to form abrasive performance enhancing composition prior to saturating the abrasive surface of the bonded abrasive article.

Embodiment 84

The method of embodiment 79, further comprising spinning the bonded abrasive article to reduce the amount of abrasive performance enhancing composition to be in a range of 0.1-15 wt % of the bonded abrasive article.

Spinning the bonded abrasive article to reduce the amount of abrasive performance enhancing composition to be in a range of 0.1-15 wt % of the bonded abrasive article.

Components Listing

Lucas TB Zinc Plus ("Lucas ZDDP") from Lucas Oil Products, Inc., USA—a mixture comprising lubricant (paraffinic oil), anti-wear agent (ZDDP—Zinc diethyldithiophosphate, Zn[(S2P(OEt)2]2), and other abrasive performance enhancing composition additives (extreme pressure additives). Lucas TB comprises approximately 74.5-58 wt % lubricant, 25-35 wt % ZDDP, and approximately 0.5-7 wt % other abrasive performance enhancing composition additives. Lucas TB has a zinc content of approximately 20,000-46,300 mg/kg, a phosphorous content of approximately 15,000-43,100 mg/kg, a sulfur content of approximately 3,204-110,000 mg/kg, and a calcium content of approximately 3,500-12,300 mg/kg.

Fevicol SH ("Fevicol SH") from Pidilite Industries, Ltd., India—A synthetic resin glue comprising polyvinyl acetate.

Bosch Extended Life Lithium Based Grease ("Bosch Grease") from Bosch Limited, India—Lithium based NLGI Class 3 Grease. Comprises grease, anti-wear agent (ZDDP), and other abrasive performance enhancing composition additives (lithium soaps & performance additives). Bosch Extended Life Lithium Based grease comprises about 0.005 to 0.008 wt % ZDDP. Bosch Grease has a zinc content of approximately 80 mg/kg, a phosphorous content of approximately 25,238 mg/kg, a sulfur content of approximately 13,700 mg/kg, and a calcium content of approximately 5,872 mg/kg.

Ganesh Antioxidant ZDDP GL9334 ("Ganesh ZDDP") from Ganesh Benzoplast Limited, India—a mixture comprising lubricant (paraffinic oil), anti-wear agent (ZDDP, and other abrasive performance enhancing composition additives (extreme pressure additives). Ganesh ZDDP comprises approximately 10-20 wt % lubricant, 80-90 wt % ZDDP, and about 0-3 wt % other abrasive performance enhancing composition additives. Ganesh ZDDP has a zinc content of approximately 105,000 mg/kg, a phosphorous content of approximately 93,000 mg/kg, and a sulfur content of approximately 195,000 mg/kg.

Shell Advance AX5 ("Shell Advance") from Royal Dutch Shell, plc. —A four-stoke engine oil (motor oil) for motorcycles available in the following viscosity grades: SAE J 300 10W-30, 10W-40, 15W-40, 15W-50, 20W-40 and 20W-50. All formulations meet: API SL and JASO MA. Shell advance is a mixture comprising lubricant (mineral motor oil), anti-wear agent (ZDDP), and other abrasive performance enhancing composition additives (extreme pressure additives, detergents). Shell Advance comprises approximately 0.1 wt % ZDDP. Shell Advance has a zinc content of approximately 1,030 mg/kg, a phosphorous content of approximately 969 mg/kg, a sulfur content of approximately 11,583 mg/kg, and a calcium content of approximately 2,150 mg/kg.

Zinc Dioctyl Primary Alkyl Dithiophosphate (RD 202-2) in lubricant oil, from Jinzhou Runda Chemical Co. Ltd., China.

Zinc Butyl Octyl Primary Alkyl Dithiophosphate (RD 201-1) in lubricant oil, from Jinzhou Runda Chemical Co. Ltd., China.

Zinc Primary-Secondary Dialkyl Dithiophosphate (RD 202-3) in lubricant oil, from China.

Molybdenum Dialkyl Dithio Phosphate (RD 106D-4) in lubricant oil, from Jinzhou Runda Chemical Co. Ltd., China.

Paraffin Heavy Liquid ("Heavy Paraffin") from Merck Millipore Corporation, India—White mineral oil. CAS-No. 8042-47-5. Notably, the Heavy Paraffin does not contain any anti-wear agent or other abrasive performance enhancing additives.

EXAMPLES

Comparative Example-1 (C1) Coated Abrasive (Untreated Control Disc)

A grinding test was performed using materials and according to the conditions below:

Abrasive disc: "Zirkon+" 36 grit abrasive disc (Saint-Gobain Abrasives, India) having a 178 mm outer diameter Disc weight: 56.1 grams Work Piece: Stainless Steel 304 work piece of about 80 mm diameter and 10 mm width The abrasive disc was mounted on a rotating rubber backing and metallic plate. While the abrasive disc was away from the metal work piece, rotation of the abrasive disc at 2600 RPM was started. Grinding was done by positioning the circular periphery of the metal work piece at an angle of 90 degrees to the plane of abrasive disc, wherein the metal work piece was touching the abrasive side of the abrasive disc at a distance of about 5 mm from the outer edge of the abrasive disc. The abrasive disc was rotated at 2600 RPM and the metal workpiece was rotated at 50 RPM and an average pneumatic load of about 4.2 kg was applied between the metal and the abrasive disc. The amount of metal removed from the workpiece was recorded after each 3 minute interval of grinding, and the grinding energy consumed during each cycle was measured. Grinding was conducted for a total of 12 minutes.

The grinding test results are shown in Table 1. The total amount of metal cut from the work piece during grinding ("Total metal cut") was 29.7 g. The total amount of energy consumed during the grinding ("Grinding energy consumed) was 616.7 kW-sec. The specific grinding energy consumed per gram of metal cut ("Specific Grinding energy consumed") was 20.76 kW-sec/g.

Comparative Example-2 (C2) Coated Abrasive (Disc w/Fevicol SH Glue)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 56.4 grams Work Piece: Stainless Steel 304 work piece of about 80 mm diameter and 10 mm width A layer of wet glue comprising polyvinyl acetate (9.8 grams of "Fevicol SH") was coated onto the abrasive surface of the disc by spreading the glue uniformly with a spatula. The coated surface area had an annular shape having an 81 mm internal diameter and 178 mm outer diameter. After application of the wet glue, the disc weighed 66.2 grams. This disc was then dried overnight at room temperature. The dried disc weighed 61 grams.

A grinding test was performed as described above in Comparative Example-1. The grinding test results are shown in Table 1. The Total metal cut was 26.9 g. The total Grinding energy consumed was 462.5 kW-sec. The Specific Grinding energy consumed was 17.9 kW-sec/g.

Inventive Example-1 (S1) Coated Abrasive (Lucas TB Zinc Plus, Single Coat)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 56.1 grams Work Piece: Stainless Steel 304 work piece of about 80 mm diameter and 10 mm width A layer of wet abrasive enhancing composition (5 grams of Lucas TB Zinc Plus) was coated onto the abrasive surface of a disc by spreading the abrasive enhancing composition uniformly with a brush. The coated surface area had an annular shape having an 81 mm internal diameter and 178 mm outer diameter. After application of the wet composition, the disc weighed 61.1 grams. This disc was then dried overnight at room temperature. The dried disc weighed 58.9 grams.

A grinding test was performed as described above in Comparative Example-1. It was observed during the start-up rotation of the disc to 2600 rpm before grinding that some of the liquid abrasive enhancement composition as applied above came off the abrasive disc. The grinding test results are shown in Table 1. The Total metal cut was 38.5 g. The total Grinding energy consumed was 615.1 kW-sec. The Specific Grinding energy consumed was 15.97 kW-sec/g.

Inventive Example-2 (S2) Coated Abrasive (Bosch Grease)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 58.5 grams.

A layer of abrasive enhancing composition (6 grams of Bosch Extended Life Lithium Based Grease) comprising a mixture of lubricant (grease), anti-wear agent (ZDDP), and other abrasive performance enhancing composition additives (lithium soaps and performance additives) was coated onto the abrasive surface of a disc by spreading the abrasive enhancing composition uniformly with a brush. The coated surface area had an annular shape having an 81 mm internal diameter and 178 mm outer diameter. After application of the composition, the disc weighed 64.5 grams. This disc was then dried overnight at room temperature. The dried disc weighed 64.5 grams.

A grinding test was performed as described above in Comparative Example-1. The grinding test results are shown in Table 1. The Total metal cut was 49.3 g. The total Grinding energy consumed was 504.8 kW-sec. The Specific Grinding energy consumed was 10.23 kW-sec/g.

Inventive Example-3 (S3) Coated Abrasive (Fevicol SH+Lucas ZDDP)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 52.7 grams.

An abrasive performance enhancing composition was first prepared by manually mixing 20 grams of Fevicol SH with 10 grams of Lucas TB Zinc Plus in a glass beaker to make a homogeneous mixture. Thus, the prepared abrasive performance enhancing composition comprised approximately 66.67 wt % fixative, 30-32.5 wt % lubricant, 0.6-1 wt % ZDDP, and 0.16 to 2.4 wt % other abrasive performance enhancing additives. A layer of the abrasive enhancing composition (13.2 grams) was coated onto the abrasive surface of a disc by spreading the abrasive enhancing composition uniformly with a brush. The coated surface area had an annular shape having an 81 mm internal diameter and 178 mm outer diameter. After application of the composition, the disc weighed 65.9 grams. This disc was then dried overnight at room temperature. The dried disc weighed 61.4 grams.

A grinding test was performed as described above in Comparative Example-1. The grinding test results are shown in Table 1. The Total metal cut was 66.6 g. The total Grinding energy consumed was 482.6 kW-sec. The Specific Grinding energy consumed was 7.24 kW-sec/g.

Grinding test was performed as mentioned in Comparative Example-1.

Inventive Example-4 (S4) Coated Abrasive (Fevicol SH+Ganesh ZDDP)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 57 grams.

An abrasive performance enhancing composition was first prepared by manually mixing 20 grams of Fevicol SH with 10 grams of Ganesh ZDDP liquid in a glass beaker to make a homogeneous mixture. Thus, the prepared abrasive performance enhancing composition comprised approximately 66.67 wt % fixative, 29.3-30.3 wt % lubricant, 3-4 wt % ZDDP, and 0 to 1 wt % other abrasive performance enhancing additives. A layer of the abrasive enhancing composition (12.6 grams) was coated onto the abrasive surface of a disc by spreading the abrasive enhancing composition uniformly with a spatula. The coated surface area had an annular shape having an 81 mm internal diameter and 178 mm outer diameter. After application of the composition, the disc weighed 69.6 grams. This disc was then dried overnight at room temperature. The dried disc weighed 65.1 grams.

A grinding test was performed as described above in Comparative Example-1. The grinding test results are shown in Table 1. The Total metal cut was 49.2 g. The total Grinding energy consumed was 484 kW-sec. The Specific Grinding energy consumed was 9.24 kW-sec/g.

Inventive Example-5 (S5) Coated Abrasive (Fevicol SH+Lucas ZDDP+KBF4)

A grinding test was performed using materials and according to the conditions below:

Abrasive disc: "Zirkon+" 36 grit abrasive disc (Saint-Gobain Abrasives, India) having a 178 mm outer diameter Disc weight before treatment: 55.5 grams.

An abrasive performance enhancing composition was first prepared by manually mixing 10 grams of Fevicol SH with 5 grams of Lucas ZDDP liquid and 5 grams of potassium tetrafluoroborate powder in a glass beaker to make a homogeneous mixture. Thus, the prepared abrasive performance enhancing composition comprised approximately 50 wt % fixative, 25 wt % grinding aid, and 22.5-24.4 wt % lubricant, 0.5-0.8 wt % ZDDP, and 0.1 to 1.8 wt % other abrasive performance enhancing additives. A layer of the abrasive enhancing composition (13.7 grams) was coated onto the abrasive surface of a disc by spreading the abrasive enhancing composition uniformly with a spatula. The coated surface area had an annular shape having an 81 mm internal diameter and 178 mm outer diameter. After application of the composition, the disc weighed 69.2 grams. This disc was then dried overnight at room temperature. The dried disc weighed 65 grams.

A grinding test was performed as described above in Comparative Example-1. The grinding test results are shown in Table 1. The Total metal cut was 76.7 g. The total Grinding energy consumed was 381.5 kW-sec. The Specific Grinding energy consumed was 4.97 kW-sec/g.

TABLE 1

Grinding Data

| | Short Description | Total cut (grams)1 | Grinding energy consumed (kW · sec)2 | Specific Grinding energy consumed (kW · sec per gram cut)3 | Comparison Total Cut to Untreated Control | Comparison Specific Grinding Energy to Untreated Control |
|---|---|---|---|---|---|---|
| C1 | Untreated Control Disc | 29.7 | 616.7 | 20.76 | 1.00 | 1.00 |
| C2 | Fevicol SH Only | 26.9 | 462.5 | 17.19 | 0.91 | 0.83 |
| S1 | Lucas ZDDP 1-coat | 38.5 | 615.1 | 15.97 | 1.30 | 0.77 |
| S2 | Bosch Grease 1-coat | 49.3 | 504.8 | 10.23 | 1.66 | 0.49 |
| S3 | Fevicol SH + Lucas ZDDP | 66.6 | 482.6 | 7.24 | 2.24 | 0.35 |
| S4 | Fevicol + Ganesh ZDDP | 49.2 | 484 | 9.24 | 1.66 | 0.45 |
| S5 | Fevicol SH + Lucas ZDDP + KB F4 | 76.7 | 381.5 | 4.97 | 2.58 | 0.24 |

1. 12 minutes of grinding
2. Per the 12 minutes of grinding
3. Per the 12 minutes of grinding Comparative Example-6 (C6) Bonded Abrasive—Plunge Grinding (Comparative Control Wheel)

A plunge grinding test was performed using materials and according to the conditions below:

Abrasive wheel: "J+" vitrified wheel of 200 mm dia and ½" thick (Saint-Gobain Abrasives, India)

Wheel weight: 841.3 grams.

Work Piece: Mild Steel (155 mm length, Vickers hardness of 132.5 plus/minus 9.7)

Plunge grinding was conducted with 0.05 mm cut in each pass. The wheel got stalled after cutting a total of 13 grams of metal.

Inventive Example-7 (S7) Bonded Abrasive—Plunge Grinding (Shell Advance 20W-40)

A plunge grinding test was performed using materials and according to the conditions below:

Abrasive wheel: "J+" vitrified wheel of 200 mm dia and ½" thick (Saint-Gobain Abrasives, India)

Wheel weight before treatment: 837.7 grams.

Work Piece: Mild Steel (155 mm length, Vickers hardness of 132.5 plus/minus 9.7)

The vitrified wheel was immersed in Shell Advance 20W-40 motor oil at room temperature for about 15 minutes. The vitrified wheel was then removed from the oil, held vertically, and allowed to drain for 30 minutes. The wheel weighed 970 grams after draining. The wheel was then spun at 2800 rpm for 10 minutes (time elapsed from pressing the button to spin to pressing the button to turn off the spinning). The wheel weighed 847.6 grams after spinning. The retained oil content dispersed within the body of the wheel was 9.9 grams (approximately 1.2 wt % of the treated wheel).

Plunge grinding was conducted as above in Comparative Example-6. The treated wheel cut a total of 227 grams of metal, upon which the wheel had not gotten stalled and the plunge grinding test was then stopped.

Comparative Example-8 (C8) Bonded Abrasive Longitudinal Grinding (Untreated Control Wheel)

A longitudinal grinding test was performed using materials and according to the conditions below:

Abrasive wheel: "J+" vitrified wheel of 200 mm outer dia, 31.75 mm internal diameter, 13 mm thickness (Saint-Gobain Abrasives, India)

Wheel weight: 834.4 grams.

Work Piece: Mild Steel (155 mm length, 100 mm width, 25 mm thickness, and Rockwell hardness of 65HRB)

Figure 8:
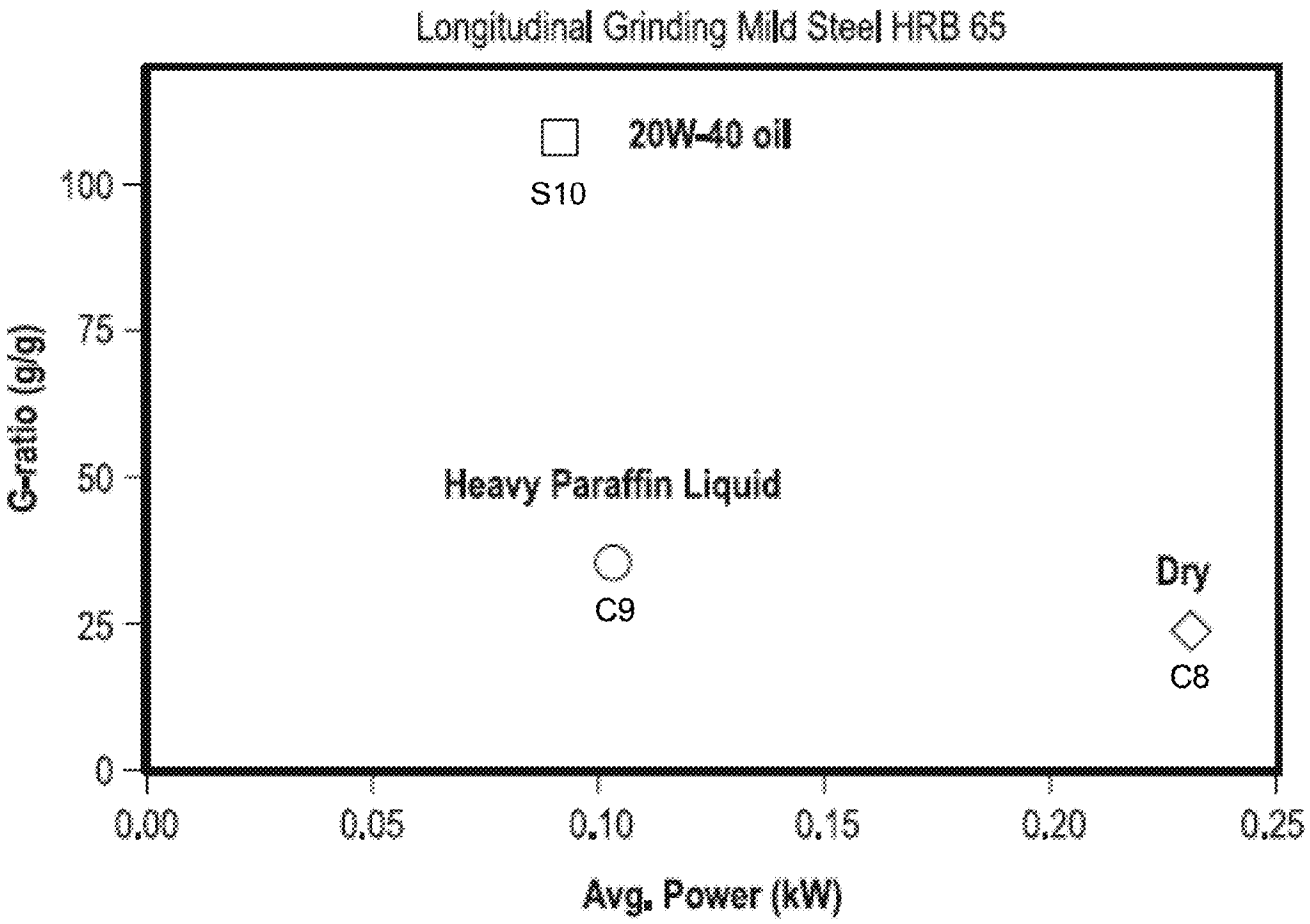
FIG. 8 is a graph showing comparative data of grind ratio to Avg. Power on mild steel HRB 65 for comparative grinding wheel embodiments (Dry, Paraffin) and inventive grinding wheel embodiments (Motor Oil w/ZDDP) that include an abrasive performance enhancing composition.
Figure 9:
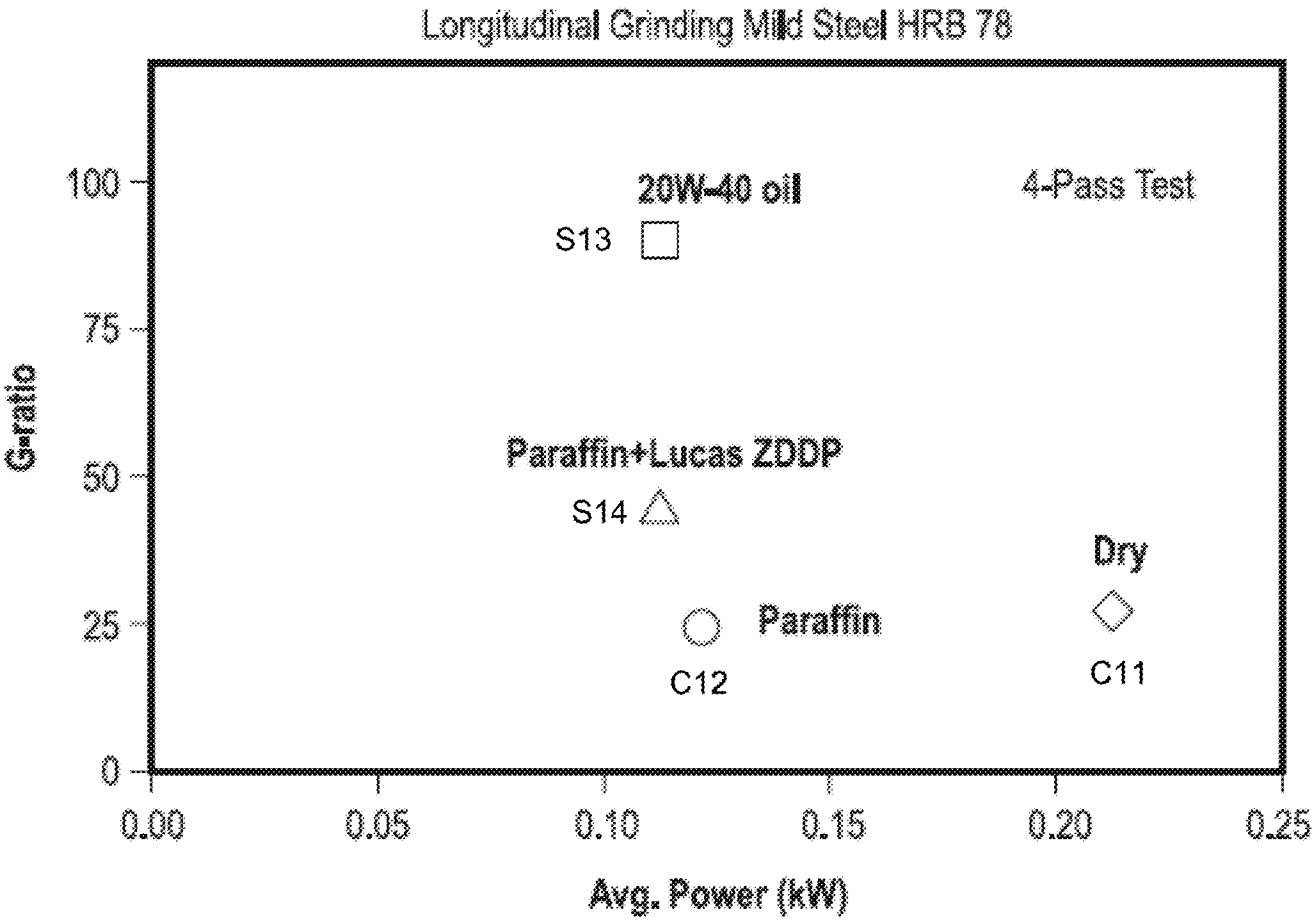
FIG. 9 is a graph showing comparative data of grind ratio to Avg. Power on mild steel HRB 78 for comparative grinding wheel embodiments (Dry, Paraffin) and inventive grinding wheel embodiments (Motor Oil w/ZDDP, Paraffin and Lucas ZDDP) that include an abrasive performance enhancing composition.
Figure 10:
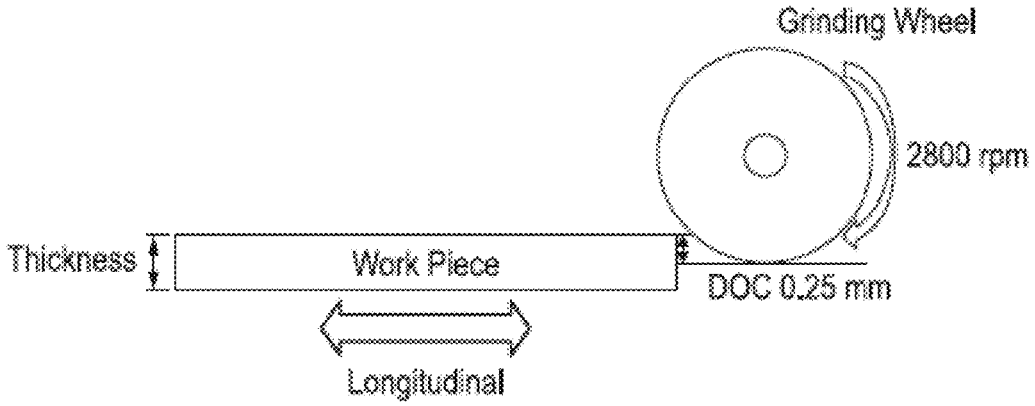
FIG. 10 is a side view illustration showing the path a grinding wheel traverses longitudinally during a longitudinal grinding test.
Figure 11:
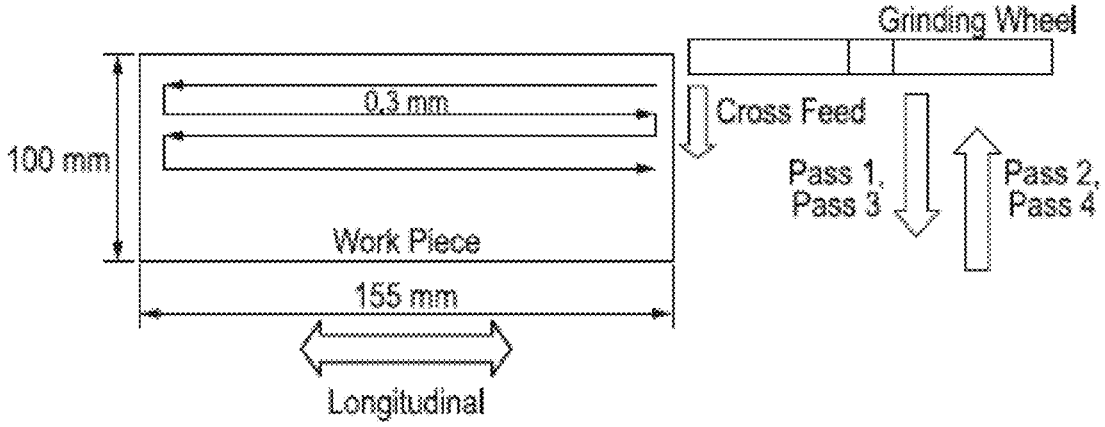
FIG. 11 is a top view illustration showing the path a grinding wheel traverses in the cross feed direction (normal to the longitudinal movement) during a longitudinal grinding test.

The abrasive wheel was mounted on the spindle of the surface grinder. As shown in FIG. 7 the grinding wheel traverses longitudinally (along the 155 mm length) at a 0.25 mm depth of cut. As shown in FIG. 8, at the end of every traverse pass, a step feed of 0.3 mm is given in the cross feed direction (normal to the longitudinal movement). FIG. 8 indicates schematically one pass. Likewise, three more passes were taken and in total there were two each forward and reverse passes. The wheel rotation was at 2800 rpm, the cross feed was 0.3 mm per sec, and the traverse feed was 7 to 9 meters per minute.

The total amount of metal removed was recorded during four (4) passes of grinding. The grinding energy consumed during the four (4) passes was measured. The amount of material shed by the wheel during grinding was recorded. The grind ratio (volume of metal removed/volume of wheel shed) was computed. The results shown in FIG. 5 and Table 2.

Comparative Example-9 (C9) Bonded Abrasive—Longitudinal Grinding (Heavy Paraffin Liquid)

A longitudinal grinding test was performed using materials and according to the conditions below:

Abrasive wheel: "J+" vitrified wheel of 200 mm outer dia, 31.75 mm internal diameter, 13 mm thickness (Saint-Gobain Abrasives, India)

Wheel weight before treatment: 866.2 grams.

Work Piece: Mild Steel (155 mm length, 100 mm width, 25 mm thickness, and Rockwell hardness of 65HRB)

The vitrified wheel was immersed in heavy paraffin at room temperature for about 15 minutes. The vitrified wheel was then removed from the paraffin, held vertically, and allowed to drain for 30 minutes. The wheel weighed 1050 grams after draining. The wheel was then spun at 2800 rpm for 10 minutes (time elapsed from pressing the button to spin to pressing the button to turn off the spinning). The wheel weighed 875.7 grams after spinning. The retained oil content dispersed within the body of the wheel was 9.5 grams (approximately 1.1 wt % of the treated wheel).

A Longitudinal Grinding test was performed as in Comparative Example-8. The results are shown in FIG. 5 and Table 2.

Inventive Example-10 (S10) Bonded Abrasive—Longitudinal Grinding (Shell Advance 20W-40 oil)

A longitudinal grinding test was performed using materials and according to the conditions below:

Abrasive wheel: "J+" vitrified wheel of 200 mm outer dia, 31.75 mm internal diameter, 13 mm thickness (Saint-Gobain Abrasives, India)

Wheel weight before treatment: 847.2 grams.

Work Piece: Mild Steel (155 mm length, 100 mm width, 25 mm thickness, and Rockwell hardness of 65HRB)

The vitrified wheel was immersed in Shell Advance 20W-40 oil at room temperature for about 15 minutes. The vitrified wheel was then removed from the oil, held vertically, and allowed to drain for 30 minutes. The wheel weighed 1030 grams after draining. The wheel was then spun at 2800 rpm for 10 minutes (time elapsed from pressing the button to spin to pressing the button to turn off the spinning). The wheel weighed 858.3 grams after spinning. The retained oil content dispersed within the body of the wheel was 11.3 grams (approximately 1.3 wt % of the treated wheel).

A Longitudinal Grinding test was performed as in Comparative Example-8. The results are shown in FIG. 6 and Table 2.

Comparative Example-11 (C11) Bonded Abrasive—Longitudinal Grinding (Untreated Control Wheel)

A longitudinal grinding test was performed using materials and according to the conditions below:

Abrasive wheel: "J+" vitrified wheel of 200 mm outer dia., 31.75 mm internal diameter, 13 mm thickness (Saint-Gobain Abrasives, India)

Wheel weight: 840.5 grams.

Work Piece: Mild Steel (155 mm length, 100 mm width, 50 mm thickness, and Rockwell hardness of 78HRB)

A Longitudinal grinding test was conducted as above in Comparative Example 8.

The results are shown in FIG. 6 and Table 2.

Comparative Example-12 (C12) Bonded Abrasive—Longitudinal Grinding (Heavy Paraffin Liquid)

A longitudinal grinding test was performed using materials and according to the conditions below:

Abrasive wheel: "J+" vitrified wheel of 200 mm outer dia., 31.75 mm internal diameter, 13 mm thickness (Saint-Gobain Abrasives, India)

Wheel weight before treatment: 861.2 grams.

Work Piece: Mild Steel (155 mm length, 100 mm width, 50 mm thickness, and Rockwell hardness of 78HRB)

The vitrified wheel was immersed in heavy paraffin at room temperature for about 15 minutes. The vitrified wheel was then removed from the paraffin, held vertically, and allowed to drain for 30 minutes. The wheel weighed 1035 grams after draining. The wheel was then spun at 2800 rpm for 10 minutes (time elapsed from pressing the button to spin to pressing the button to turn off the spinning). The wheel weighed 871.6 grams after spinning. The retained oil content dispersed within the body of the wheel was 10.4 grams (approximately 1.2 wt % of the treated wheel).

A Longitudinal Grinding test was performed as in Comparative Example-8. The results are shown in FIG. 6 and Table 2.

Inventive Example-13 (S13) Bonded Abrasive—Longitudinal Grinding (Shell Advance 20W-40 Oil)

A longitudinal grinding test was performed using materials and according to the conditions below:

Abrasive wheel: "J+" vitrified wheel of 200 mm outer dia., 31.75 mm internal diameter, 13 mm thickness (Saint-Gobain Abrasives, India)

Wheel weight before treatment: 836.7 grams.

Work Piece: Mild Steel (155 mm length, 100 mm width, 50 mm thickness, and Rockwell hardness of 78HRB)

The vitrified wheel was immersed in Shell Advance 20W-40 oil at room temperature for about 15 minutes. The vitrified wheel was then removed from the oil, held vertically, and allowed to drain for 30 minutes. The wheel weighed 1015 grams after draining. The wheel was then spun at 2800 rpm for 10 minutes (time elapsed from pressing the button to spin to pressing the button to turn off the spinning). The wheel weighed 847.2 grams after spinning. The retained oil content dispersed within the body of the wheel was 10.5 grams (approximately 1.2 wt % of the treated wheel).

A Longitudinal Grinding test was performed as in Comparative Example-8. The results are shown in FIG. 6 and Table 2.

Inventive Example-14 (S14) Bonded Abrasive—Longitudinal Grinding (Heavy Paraffin+Lucas ZDDP)

A longitudinal grinding test was performed using materials and according to the conditions below:

Abrasive wheel: "J+" vitrified wheel of 200 mm outer dia., 31.75 mm internal diameter, 13 mm thickness (Saint-Gobain Abrasives, India)

Wheel weight before treatment: 840.5 grams.

Work Piece: Mild Steel (155 mm length, 100 mm width, 50 mm thickness, and Rockwell hardness of 78HRB)

An abrasive performance enhancing composition was first prepared by manually mixing 120 g of Heavy Paraffin liquid with 80 g of Lucas ZDDP. Thus, the prepared abrasive performance enhancing composition comprised approximately 96-99 wt % lubricant, 0.8-1.2 wt % ZDDP, and 0.2 to 2.8 wt % other abrasive performance enhancing additives. The vitrified wheel was immersed in Shell Advance 20W-40 oil at room temperature for about 15 minutes. The vitrified wheel was then removed from the oil, held vertically, and allowed to drain for 30 minutes. The wheel weighed 1015 grams after draining. The wheel was then spun at 2800 rpm for 10 minutes (time elapsed from pressing the button to spin to pressing the button to turn off the spinning). The wheel weighed 847.2 grams after spinning. The retained oil content dispersed within the body of the wheel was 10.5 grams (approximately 1.2 wt % of the treated wheel).

A Longitudinal Grinding test was performed as in Comparative Example-8. The results are shown in FIG. 6 and Table 2.

TABLE 2

Longitudinal Grinding Test Results

| | Treatment | Steel Hardness | Treatment Wt % | 4 Pass Average power Consumed (Kw) | 4 Pass G-ratio actual by weights (g/g) | Comparison to Control Average power Consumed | Comparison to Control G-ratio |
|---|---|---|---|---|---|---|---|
| C8 | Untreated | 65 | 0 | 0.2312 | 24.13 | 1.00 | 1.00 |
| C9 | Heavy Paraffin liquid | 65 | 1.1 | 0.10 | 35.63 | 0.43 | 1.48 |
| S10 | Shell Advance 20w-40 oil | 65 | 1.3 | 0.0912 | 108.04 | 0.39 | 4.48 |
| C11 | Untreated | 78 | 0 | 0.21 | 28 | 1.00 | 1.00 |
| C12 | Heavy Paraffin liquid | 78 | 1.2 | 0.120 | 25 | 0.57 | 0.89 |
| S13 | Shell Advance 20w-40 oil | 78 | 1.3 | 0.110 | 89.67 | 0.52 | 3.20 |

TABLE 2-continued

| Longitudinal Grinding Test Results | | | | | | | |
|---|---|---|---|---|---|---|---|
| | Treatment | Steel Hardness | Treatment Wt % | 4 Pass Average power Consumed (Kw) | 4 Pass G-ratio actual by weights (g/g) | Comparison to Control Average power Consumed | Comparison to Control G-ratio |
| S14 | Heavy Paraffin + Lucas ZDDP | 78 | 1.1 | 0.11 | 45 | 0.52 | 1.61 |

Example-15 Nonwoven Abrasive Disc Preparation and Testing (S16)

Figure 13:
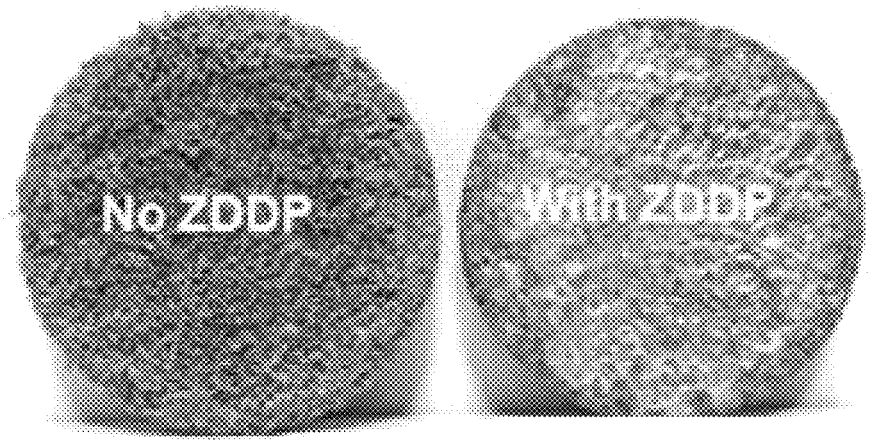
FIG. 13 is an image of a conventional nonwoven abrasive wheel and a nonwoven abrasive wheel embodiment that includes an abrasive performance enhancing composition disposed on and in the nonwoven web of fibers.

An abrasive performance enhancing composition was first prepared by manually mixing 2 parts of Elmer's Glue (polyvinyl acetate glue) one part of Lucas TB Zinc Plus in a glass beaker to make a homogeneous mixture. The uncured abrasive performance enhancing composition comprised approximately 66.7 wt % fixative (polyvinyl acetate glue), 20-25 wt % lubricant (paraffinic oil), 6-10 wt % ZDDP, and 0.16 to 2.4 wt % other abrasive performance enhancing additives. The abrasive performance enhancing composition was applied to a 3" nonwoven surface conditioning disc (P50 aluminum oxide grit) with a brush and roller so that abrasive performance enhancing composition was coated onto and seeped into the nonwoven abrasive substrate. See FIG. 13. Prior to application of the composition the nonwoven surface conditioning disc weighed 12 grams. This disc was then dried so that the composition cured. The cured disc weighed approximately 16 grams. The amount of the cured abrasive performance enhancing composition (4 grams) comprised about 25 wt % of the total weight of the completed disc. The cured abrasive performance enhancing composition comprised approximately 52-55 wt % fixative (cured polyvinyl acetate glue), 31-34 wt % lubricant (dried engine oil), 12-15 wt % ZDDP, and 0.5 to 3 wt % other abrasive performance enhancing additives. The completed inventive nonwoven abrasive disc (S16) embodiment was collected for testing.

Figure 14:
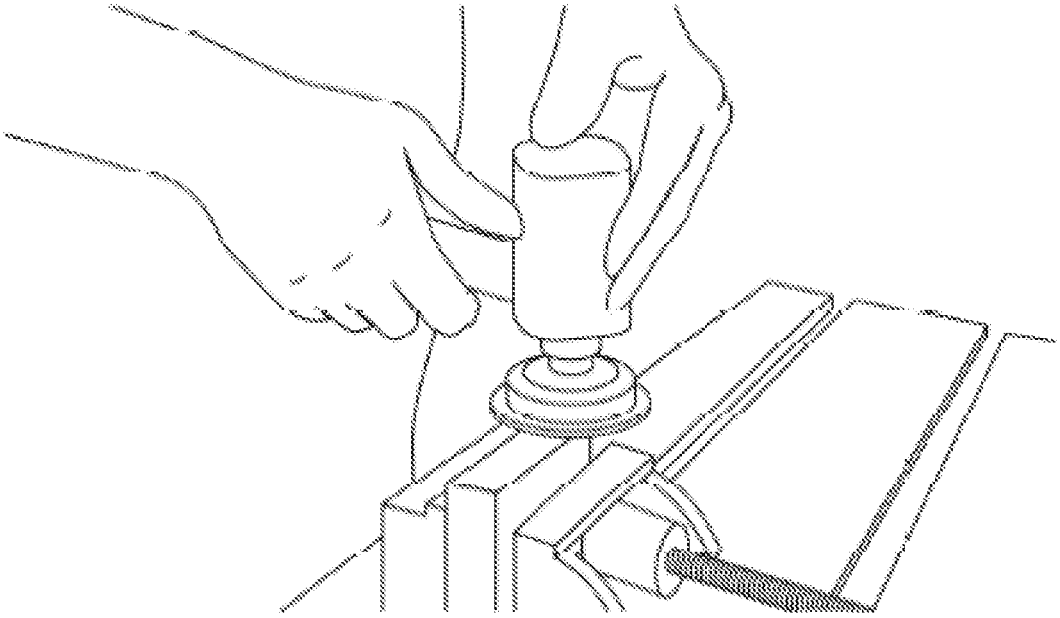
FIG. 14 shows an image of nonwoven testing set-up

The inventive nonwoven abrasive disc S16 was compared to a control nonwoven abrasive disc (C17). The only difference between the discs was that the control disc did not have the abrasive performance enhancing composition. Testing was conducted using a 3" Dynabrade offhand sander on aluminum step bars (Aluminum 775 Step Bar (5"×¼"×1/16"). See FIG. 14. The grinding test results are shown in Table 3.

TABLE 3

| Nonwoven Abrasive Disc Testing S16 | | |
|---|---|---|
| | C17 | S16 |
| Time (sec) | 57 | 46 |
| Metal cut (g) | 4.13 | 3.95 |
| Cut rate (g/min) | 4.35 | 5.15 |
| Cut rate as % of Control | 100% | 118% |

It was observed that the inventive nonwoven embodiment including the abrasive performance enhancing composition produced an improved cut rate about 18% greater than the control disc.

Example-16 Nonwoven Abrasive Testing (S17)

An additional nonwoven abrasive embodiment was prepared and abrasive testing was conducted. An inventive nonwoven abrasive disc embodiment (S17) was prepared in the same manner described above in Example 15. The inventive nonwoven abrasive disc S17 was compared to a control nonwoven abrasive disc (C18). The only difference between the discs was that the control disc did not have the abrasive performance enhancing composition. Abrasive testing was conducted on aluminum step bars in the same manner described above in Example 15. The grinding test results are shown in Table 4.

TABLE 4

| Nonwoven Abrasive Disc Testing (S17) | | |
|---|---|---|
| | C18 | S17 |
| Cut rate (g/min) | 3.95 | 4.8 |
| Cut rate as % of Control | 100% | 122% |
| Surface Roughness (Ra) | 120.9 | 87 |
| Surface Roughness as % of Control | 100% | 72% |

It was observed that the inventive nonwoven embodiment S17 including the abrasive performance enhancing composition produced an improved cut rate about 22% greater than the control disc. Surprisingly and unexpectedly, the inventive nonwoven embodiment S17 was also able to produce a surface that was 28% less rough (i.e., smoother) than the control disc.

Example 17—ZDDP Alkyl Type Abrasive Testing on Stainless Steel (S18-S23

Various abrasive performance enhancing compositions containing different ZDDP alkyl compounds were prepared by mixing 2 parts of Fevicol (polyvinyl acetate glue) with one part of the ZDDP alkyl compound in a glass beaker using an automated stirrer to make a homogeneous mixture. The formulations (S18-S21) are listed below in Table 5. The abrasive performance enhancing mixtures were applied to Zircon+brand (Saint-Gobain India) abrasive discs (36 grit alumina zirconia) using brush coating. The discs were dried at room temperature for 5 days. The completed inventive abrasive disc embodiments (S18-23) were collected for abrasive testing compared to a control disc (C24) having no coating of any kind and a control disc coated with a mixture of Fevicol and heavy paraffin. The control discs did not have any abrasive performance enhancing composition containing ZDDP. Testing was conducted on ring shaped stainless steel SS304 work pieces using a robotic grinder set to 2.2 kW, 4 kg force, 5000 rpm. The grinding test results are shown in Table 5.

TABLE 5

ZDDP Compositions Grinding Performance on SS 304 metal

| Composition | Total Cut (g) (12 min test, on SS 304) | % of Control |
|---|---|---|
| Control (C24) No composition | 89 | 100% |
| Control (C25) Fevicol + Heavy Paraffin (no ZDDP) | 74 | 83 |
| Fevicol + 20/40 Shell Oil (S18) | 111 | 125% |
| Fevicol + Zinc Dioctyl Primary Alkyl Dithiophosphate (S19) | 165 | 185% |
| Fevicol + Zinc Butyl Octyl Primary Alkyl Dithiophosphate (S20) | 182 | 204% |
| Fevicol + Zinc Primary-Secondary Dialkyl Dithiophosphate (S21) | 174 | 196% |
| Fevicol + Molybdenum Dialkyl Dithio Phosphate (S22) | 154 | 173% |
| Fevicol + Ganesh_ZDDP (Zinc C1-C14 alkyldithiophosphate) (S23) | 176 | 198% |

It was observed that all inventive embodiments produced particularly beneficial improved total cut. The least improvement, but still surprisingly significant was S18, with a 25% improvement. The highest improvement was S20, which was more than double the cut with a 104% improvement. These improved cut performances were surprising and unexpected in view that a control disc C25, which was coated with Fevicol and a heavy paraffin, the same lubricant oil carrier as for the ZDDP alkyl compounds produced even less cut than a control disk with no coating at all.

Example 18—ZDDP Blends Abrasive Testing on Stainless Steel

Various abrasive performance enhancing compositions containing a ZDDP alkyl compound and various additives were prepared using the formulations listed below in Table 6. The abrasive performance enhancing mixtures were applied directly to "Zircon+" brand (Saint-Gobain India) abrasive discs (36 grit alumina zirconia) using brush coating without any polyvinyl acetate binder. Abrasive testing of the inventive embodiments was conducted to compare performance against control discs. One minute grinding tests were conducted using a robotic grinder on stainless steel SS-304 workpieces. The only difference between the control discs and the inventive embodiments was that the control discs did not have any abrasive performance enhancing composition. The grinding test results are shown in Table 6.

TABLE 6

ZDDP Blends Abrasive Testing

| Components | Control C26 (wt %) | S24 (wt %) | S25 (wt %) | S26 (wt %) |
|---|---|---|---|---|
| Paraffin Heavy | — | 20 | — | 45 |
| Zinc Butyl Octyl Primary Alkyl Dithiophosphate | — | 10 | — | 10 |
| Shell 20/40 | — | — | 55 | — |
| Chlorinated Paraffin | — | 25 | — | — |
| Amine phosphate | — | 20 | 20 | 20 |
| Zinc Stearate | — | 25 | 25 | 25 |
| Total Cut (1 min.) | 1X | 2.5X | 1.4X | 1.6X |

It was observed that all inventive embodiments produced particularly beneficial improved total cut. The least improvement, but still surprisingly significant was S25, with an approximate 40% improvement. The highest improvement was S24, which was more than double the cut with an approximate 150% improvement. These improved cut performances were surprising and appeared to be produced, at least in part, from synergistic effects produced by the combination of additives, namely the chlorinated paraffin, amine phosphate, and zinc stearate.

Example 19. Coated Abrasives Including an Abrasive Performance Enhancing Composition in a Size Coat, a Supersize Coat, or Both A size coat including an abrasive performance enhancing composition was prepared by mixing together components according to the formulation shown in Table 7. A supersize coat including an abrasive performance enhancing composition was prepared. The formulations are given below in Table 7.

TABLE 7

Size Coat and Supersize Coat Formulations

| Components | Control Size Coat (C27) wt % | Size Coat S28 (wt %) | Supersize Coat S29 (wt %) | Supersize Coat S30 (wt %) |
|---|---|---|---|---|
| Phenol Formaldehyde resin | 66.5% | 39.2% | 29.8% | 29.8% |
| Calcium Carbonate | 33.3% | 19.6% | 29.8% | 0% |
| Pigment | 0.2% | 0.1% | 0% | 0% |
| water | Amount to adjust viscosity | 5.8% | 9.0% | 9.0% |
| ZDDP | 0% | 29.3% | 22.4% | 22.4% |
| Dispersing Agent (Daxad11) | 0% | 5.9% | 9.0% | 9.0% |
| KBF4 | 0% | 0 | 0% | 29.8 |

Figure 12A:
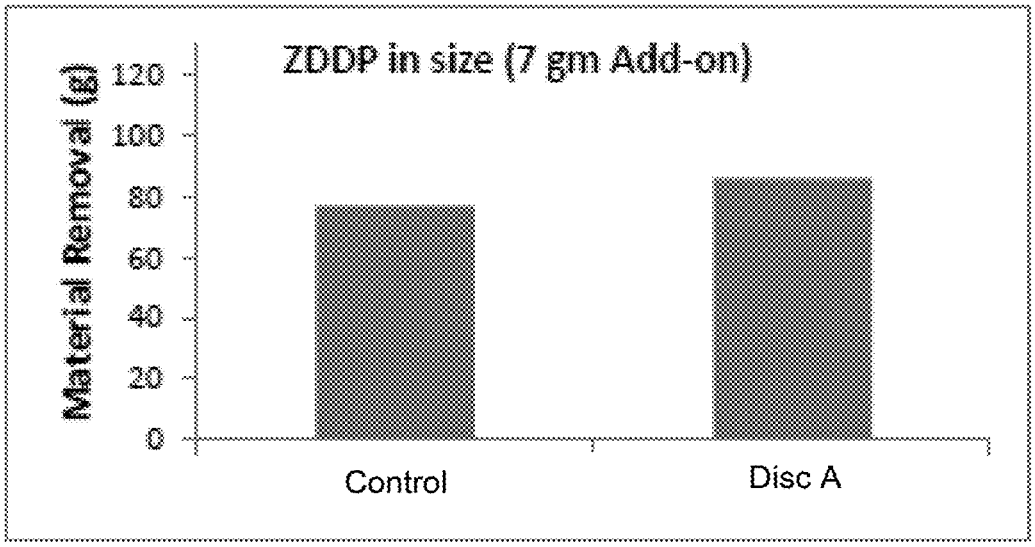
FIG. 12A is a bar graph comparing material removal data from a workpiece for a control abrasive disc and a inventive abrasive disc embodiment that includes an abrasive performance enhancing composition in a size coat.
Figure 12B:
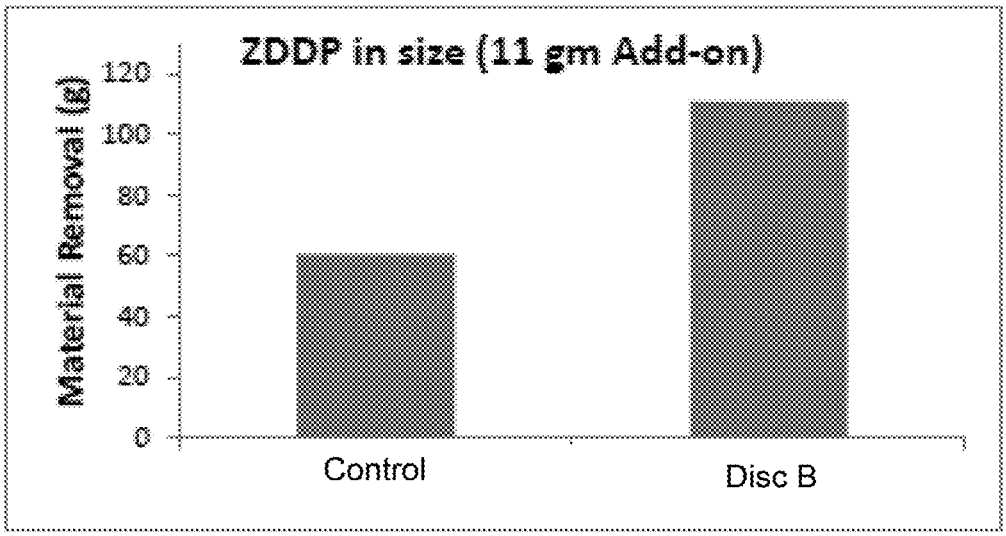
FIG. 12B is a bar graph comparing material removal data from a workpiece for a control abrasive disc and an inventive abrasive disc embodiment that includes an abrasive performance enhancing composition in a size coat.
Figure 12C:
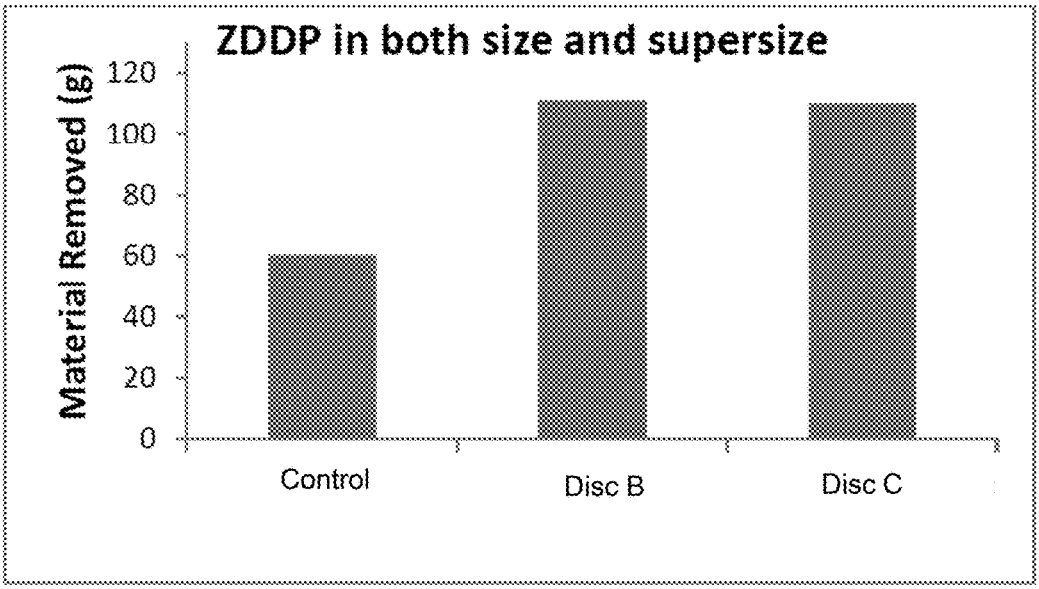
FIG. 12C is a bar graph comparing material removal data from a workpiece for a control abrasive disc, an inventive abrasive disc embodiment that includes an abrasive performance enhancing composition in a size coat, and an inventive abrasive disc embodiment that includes an abrasive performance enhancing composition in a supersize size coat.
Figure 12D:
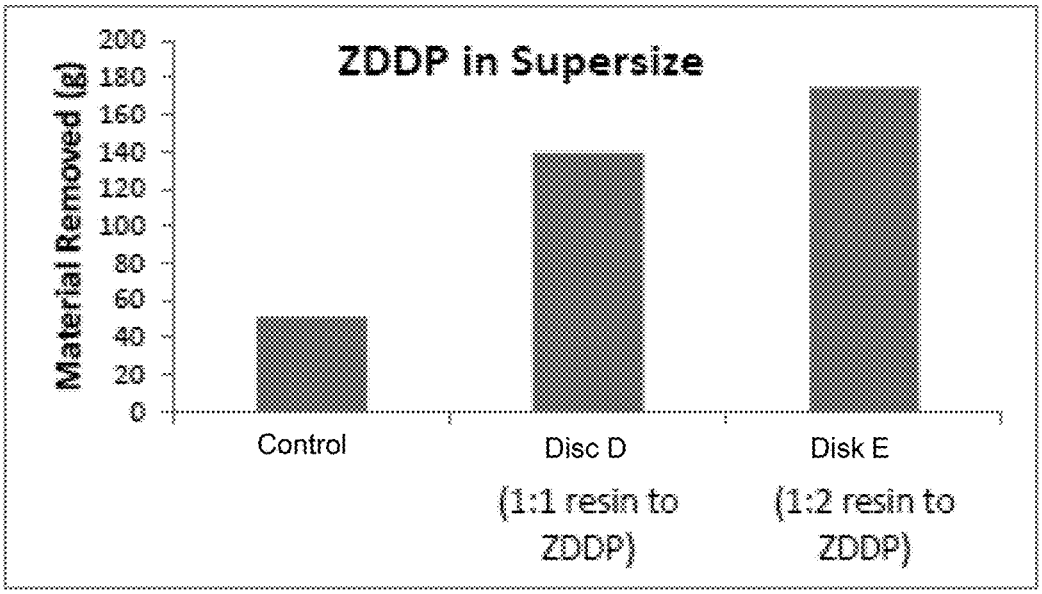
FIG. 12D is a bar graph comparing material removal data from a workpiece for a control abrasive disc, an inventive abrasive disc embodiment that includes an abrasive performance enhancing composition in a supersize coat, and another inventive abrasive disc embodiment that includes an abrasive performance enhancing composition in a supersize size coat.

A size coat was prepared using the S28 formulation and approximately 7 grams was applied as a size coat on a first coated abrasive fiber disc to form an inventive embodiment (Disk A). A second coated abrasive fiber disc (Disk B) was prepared, but this time 11 g of the S28 formulation was applied as a size coat. A third coated abrasive fiber disc (Disk C) was prepared, which included 6 g of the S28 formulation was applied as a size coat and 6 grams of the S29 supersize formulation applied as a size coat. The inventive embodiment (Disks A, B, and C) were tested against a control disc C27 that did not have any ZDDP in the size coat and that did not have a supersize coat. The results of the testing are shown in Table 8 and FIG. 12A, FIG. 12B, and FIG. 12 C.

TABLE 8

Disc Testing Size Coat and Supersize Coat Formulations

| | Control Disc | Inv. Disc A | Inv. Disc B | Inv. Disc C | Inv. Disc D | Inv. Disc E |
|---|---|---|---|---|---|---|
| Size Coat | C27 No ZDDP | S28 7 g add-on | S28 11 g add-on | S28 6 g add-on | Same as Control No ZDDP | Same as Control No ZDDP |
| Supersize Coat | No Supersize | No Supersize | No Supersize | S29 6 g add-on | S29 1:1 resin to ZDDP | S29 1:2 resin to ZDDP |
| Cut | X1 | X1.1 | X1.8 | X1.8 | X2.5 | X3.0 |

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The invention claimed is:

1. A fixed abrasive article comprising:
abrasive particles;
a binder composition; and
an abrasive performance enhancing composition,
wherein the abrasive particles are disposed on or in the binder composition, and
wherein the abrasive performance enhancing composition is disposed overlying the abrasive particles or binder composition or both, and,
wherein the abrasive performance enhancing composition comprises
a mixture comprising
a lubricant,
a fixative, and
an anti-wear agent comprising an organo phosphate that includes a transition metal,
wherein the fixative comprises an organic binder, and
wherein the organophosphate comprises a dialkyl dithio phosphate.

2. The fixed abrasive article of claim 1, wherein the mixture is dried or cured.

3. The fixed abrasive article of claim 1, wherein the lubricant comprises a hydrocarbon material.

4. The fixed abrasive article of claim 1, wherein the organophosphate comprises a molybdenum dithiophosphate, a molybdenum dialkyl dithiophosphate, a zinc dithiophosphate (ZDP), a zinc dialkyl dithio phosphate (ZDDP), or a combination thereof.

5. The fixed abrasive article of claim 1, further comprising an abrasive performance enhancing additive.

6. The fixed abrasive article of claim 1, further comprising a grinding aid.

7. The fixed abrasive article of claim 1, wherein the lubricant comprises not less than 1 wt % and not greater than 99.9 wt % of the abrasive performance enhancing composition.

8. The fixed abrasive article of claim 1, wherein the anti-wear agent comprises not less than 0.001 wt % and not greater than 90 wt % of the abrasive performance enhancing composition.

9. The fixed abrasive article of claim 1, wherein the fixative comprises not less than 10 wt % and not greater than 90 wt % of the abrasive performance enhancing composition.

10. The fixed abrasive article of claim 5, wherein the abrasive performance enhancing additive comprises not less than 0.001 wt % and not greater than 35 wt % of the abrasive performance enhancing composition.

11. The fixed abrasive article of claim 6, wherein the grinding aid comprises not less than 1 wt % and not greater than 40 wt % of the abrasive performance enhancing composition.

12. The fixed abrasive article of claim 1, wherein the abrasive performance enhancing composition comprises a beneficial amount of zinc, phosphorous, sulfur, calcium, or a combination thereof.

13. The fixed abrasive article of claim 1, further comprising a backing material, wherein the abrasive particles and binder composition are disposed on the backing material.

14. The fixed abrasive article of claim 13, wherein the abrasive performance enhancing composition is disposed as a size coat overlying the abrasive particles and the binder composition.

15. The fixed abrasive article of claim 13, further comprising a size coat and a supersize coat, wherein the size coat is disposed overlying the abrasive particles and the binder composition, wherein the supersize coat is disposed overlying the size coat, and wherein the abrasive performance enhancing composition is disposed in the supersize coat.

16. The fixed abrasive article of claim 13, further comprising a size coat and a supersize coat, wherein the size coat is disposed overlying the abrasive particles and the binder composition, wherein the supersize coat is disposed overlysing the size coat, and wherein the abrasive performance enhancing composition is disposed in the size coat and the supersize coat.

17. The fixed abrasive article of claim 1, further comprising an abrasive performance enhancing additive, a grinding aid, or a combination thereof.

* * * * *